US006111512A

United States Patent [19]

Sugimoto et al.

[11] Patent Number: 6,111,512

[45] Date of Patent: Aug. 29, 2000

[54] FIRE DETECTION METHOD AND FIRE DETECTION APPARATUS

[75] Inventors: Iwao Sugimoto, Nerima-ku; Masayuki Nakamura, Higashiyamato; Hiroki Kuwano, Koganei, all of Japan

[73] Assignee: Nippon Telegraph and Telephone Corporation, Tokyo, Japan

[21] Appl. No.: 09/041,571

[22] Filed: Mar. 12, 1998

[30] Foreign Application Priority Data

| | | | |
|---|---|---|---|
| Mar. 13, 1997 | [JP] | Japan | 9-078905 |
| Mar. 13, 1997 | [JP] | Japan | 9-078906 |
| Jul. 16, 1997 | [JP] | Japan | 9-191301 |

[51] Int. Cl.[7] ..... G08B 17/12

[52] U.S. Cl. ..... 340/577; 511/522; 511/632

[58] Field of Search ..... 340/577, 579, 340/584, 628, 632, 633, 634, 629, 521, 522, 511, 517

[56] References Cited

U.S. PATENT DOCUMENTS

| | | | |
|---|---|---|---|
| 4,223,559 | 9/1980 | Chuan et al. | 73/432 |
| 5,065,140 | 11/1991 | Neuburger | 340/634 |
| 5,189,399 | 2/1993 | Beyersdorf | 340/629 |
| 5,281,951 | 1/1994 | Okayama | 340/511 |
| 5,486,811 | 1/1996 | Wehrle et al. | 340/522 |
| 5,731,510 | 3/1998 | Jones et al. | 73/23.31 |
| 5,767,776 | 6/1998 | Wong | 340/632 |
| 5,856,780 | 1/1999 | McGeehin | 340/540 |
| 5,869,763 | 2/1999 | Vig et al. | 73/580 |
| 5,892,141 | 4/1999 | Jones et al. | 73/24.03 |
| 6,006,589 | 12/1999 | Rodahl et al. | 73/54.41 |

*Primary Examiner*—Nina Tong
*Attorney, Agent, or Firm*—Fitch, Even, Tabin & Flannery

[57] ABSTRACT

Novel fire detection method and apparatus for positively detecting a fire in the stage of initial smoldering fire or smokeless burning with a high sensitivity. A sensor apparatus disposed in an area i makes gas detection and gas recognition using an existing pattern recognition method such as principal component analysis. If no gas is detected, flag $f_i$=0 is set. If a gas is detected and recognized as a water vapor, $f_i$=1 is set. If it is not recognized as a water vapor, $f_i$=0 is set. Monitoring N areas as above, $J=f_1+f_2+ \ldots +f_N$ is calculated, if $0<J<N$, an area of $f_i$=1 is recognized as highly possible to be a fire. When J=0 or J=N, it is recognized as a non-fire since it is highly possible as due to detection of a gas other than a water vapor such as alcohol or an ordinary humidity change.

19 Claims, 16 Drawing Sheets

FIRE DETECTION METHOD AND FIRE DETECTION APPARATUS

The present application is based on applications Japanese Patent Application No. 9-78905, Japanese Patent Application No. 9-78906, and Japanese Patent Application No. 9-191301 filed in Japan, the contents of which are incorporated hereinto by reference.

BACKGROUND OF THE INVENTION

1. Field of the Invention

The present invention relates to a fire detection method and a fire detection apparatus and to a recording medium recorded with a fire detection program and a fire detection data, particularly to a technology for detecting at an initial stage of a fire which increases in humidity by heating among fires generated by heating some objects such as heat evolution of an apparatus due to overload or heat generation in electric wiring.

2. Description of Related ART

In a prior art fire detection method, smoke, heat, burning gas, or organic gas generated by a fire has been sensed. As such a fire detector, there is a smoke detector, a heat detector, a carbonic acid gas detector, a chlorine gas detector, or the like.

However, the above prior art fire detectors have the following problems which have yet to be solved. Specifically, since the smoke detector, heat detector, and the like sense smoke or heat which is necessarily generated during a fire, they are positive to find a fire, however, are low in sensitivity to find a fire in the stage of smoldering or baking before generating flame or smoke or smokeless burning. Further, the chlorine gas detector is high in sensitivity, however, all combustibles don't generate chlorine gas, and it cannot be a general-purpose fire detector.

On the other hand, in a facility having an expensive machine such as communications apparatus, it is necessary to positively sense a fire at an early time, possibly in the stage of smoldering or baking before generating flame or smoke or smokeless burning, and reduce the damage to a minimum.

Except for gasoline, explosive, or propane gas which is highly inflammable in itself, such materials as wood, paper, resins, and paints used in architectural materials or various indoor equipment and apparatus, when heated, first undergo a humidity change (humidity increase) by evaporation of water which adsorbed on the surface of the above materials before thermal decomposition. Therefore, in a fire generated by heating an object such as heat evolution due to overload of an apparatus or heat generation in electric wiring, there is a humidity increase in the stage of initial baking or smokeless burning, and the inventors have confirmed that, if this humidity increase can be detected, early detection of a fire becomes possible. Thus, the inventors have accomplished the present invention with this consideration.

SUMMARY OF THE INVENTION

Accordingly, an object of the present invention is to provide a novel fire detection method which detects a fire with a high sensitivity in the stage of initial baking or smokeless burning.

Another object of the present invention is to provide a highly sensitive, inexpensive fire detection apparatus which can be achieved with an inexpensive quartz crystal microbalance.

A further object of the present invention is to provide a recording medium recorded with a program for the above fire detection and with a fire detection data.

According to the first aspect of the present invention, a fire detection method comprises the steps of:

detecting a humidity increase in an initial stage of a fire using a plurality of sensors; and detecting a fire according to the detected humidity increase.

In the fire detection method, the sensor may have a burning gas detection function, and may further comprise a step for recognizing a fire when generation of a burning gas and the humidity increase are detected almost simultaneously.

According to the second aspect of the present invention, a fire detection method comprising the steps of:

detecting humidity increases in a plurality of places by a plurality of sensor apparatuses respectively disposed at the plurality of places to be detected for a fire; and recognizing a fire when humidity increases in one or more places are greater than humidity increases in other places.

In the fire detection method, the step for detecting humidity changes in a plurality of places may comprise the steps of:

detecting resonance frequency changes according to mass changes of detected gases from outputs of the sensor apparatuses provided with a plurality of quartz crystal microbalances respectively having different films formed on the surfaces;

processing the resonance frequency changes;

recognizing a gas type of detected gas by matching data of processing result obtained in the processing step with a previously prepared database; and repeating the detecting step and the recognizing step successively to each of the plurality of sensor apparatuses.

Here, the fire detection method may further comprise a step for detecting generation of burning gas due to a fire by matching data of processing result obtained in the processing step with the database continuously, when the detected gas is recognized as a water vapor by the recognizing step.

In the fire detection method, the recognizing step may make recognition of the gas type using a pattern recognition method of principal component analysis.

Here, the fire detection method may further comprise a step which when a humidity increase is detected by the recognizing step and it is highly possible to be a fire, in a gas classification map of principal component analysis as the database, a distance $D_t$ between a response Y of the sensor apparatus and the center of cluster of burning gas is calculated, the distance $D_t$ and an immediately previous distance $D_{t-1}$ are compared, if $D_t<D_{t-1}$, a flag S is increment by 1, if $D_t>D_{t-1}$, the flag S is reset to 0, this procedure is repeated several times, and when S exceeds a reference number of times M, response Y of the sensor apparatus is recognized to approach the cluster of burning gas to recognize a fire.

According to the third aspect of the present invention, a fire detection apparatus comprises:

detection means for detecting a humidity increase in an initial stage of a fire using a plurality of sensors; and recognizing means for recognizing a fire according to a humidity increase detected by the detection means.

In the fire detection apparatus, the sensors may also have a burning gas detection function, and the recognizing means may recognize a fire when detecting generation of the burning gas and the humidity increase are detected almost simultaneously.

According to the fourth aspect of the present invention, a fire detection apparatus comprises:

detection means for detecting humidity increases in a plurality of places by a plurality of sensor apparatuses respectively disposed at the plurality of places to be detected for a fire; and recognizing means for recognizing a fire when humidity increases at one or more places are greater than humidity increases in other places.

In the fire detection apparatus, the detection means may comprise:

first processing means for detecting frequency changes according to mass changes of detected gases using outputs of the sensor apparatuses provided with a plurality of quartz crystal microbalances respectively having different films formed on the surfaces;

second processing means for processing the resonance frequency changes;

third processing means for recognizing a gas type of detected gas by matching data of processing result obtained by the second processing means with a previously prepared database; and processing means for repeating the first to third processing means successively to each of the plurality of sensor apparatuses.

In the fire detection apparatus, the recognizing means may detect generation of burning gas due to a fire by matching data of processing result obtained by the second processing means with the database continuously, when the detected gas is recognized as a water vapor by the third processing means.

In the fire detection apparatus, the third processing means may make recognition of the gas type using a pattern recognition method of principal component analysis.

In the fire detection apparatus, the recognizing means which when a humidity increase is detected by the third processing means and it is recognized as highly possible to be a fire, in a gas classification map of principal component analysis as the database, a distance $D_t$ between a response Y of the sensor apparatus and the center of cluster of burning gas is calculated, the distance $D_t$ and an immediately previous distance $D_{t-1}$ are compared, if $D_t<D_{t-1}$, a flag S is increment by 1, if $D_t>D_{t-1}$, the flag S is reset to 0, this procedure is repeated several times, and when S exceeds a reference number of times M, response Y of the sensor apparatus is recognized to approach the cluster of burning gas to recognize a fire.

In the fire detection apparatus, the detection means may comprise, by sputtering a sintered polymer formed by hot-pressing granules of hydrocarbon polymers with particle diameters ranging from 50 to 200 micrometers, a chemical sensor probe having a hydrocarbon-based polymer thin film on a piezoelectric mass transducer, the hydrocarbon-based polymer thin film containing carbon, hydrogen, and oxygen, and content of the oxygen is within a range from 2 to 20%.

In the fire detection apparatus, the polymer thin film may be formed by, when sputtering a sputtering target in a radio-frequency discharge, using a sintered polymer formed by hot-pressing granules of hydrocarbon polymers having particle diameters ranging from 50 to 200 micrometers as the sputtering target.

In the fire detection apparatus, the detection means may comprise, on the surface of a piezoelectric mass transducer, a chemical sensor probe having an organic thin film by spattering with an organic material as a target and with an induction coupled plasma ion source.

In the fire detection apparatus, the organic thin film may be formed by a sputtering with an organic material as a target and with an induction coupled plasma ion source.

According to the fifth aspect of the present invention, a recording medium recorded with a fire detection program for making fire detection by a computer, the fire detection program may cause the computer:

to detect humidity increases in a plurality of places by a plurality of sensor apparatuses respectively disposed at the plurality of places to be detected for a fire; and to recognize a fire when humidity increases in one or more places are greater than humidity increases in other places.

In the recording medium, the fire detection program may cause the computer, when detecting humidity changes in the plurality of places:

to detect resonance frequency changes according to mass changes of detected gases using outputs of the sensor apparatuses provided with a plurality of quartz crystal microbalances respectively having different films formed on the surfaces;

to process the resonance frequency changes;

to recognize a gas type of detected gas by matching data of the processing result with a previously prepared database; and to repeat the respective operations successively to each of the plurality of sensor apparatuses.

In the recording medium, the fire detection program may cause the computer to detect generation of burning gas due to a fire by matching data of processing result with the database continuously, when the computer is caused to recognize the detected gas as water vapor.

In the recording medium, the fire detection program may cause the computer to make recognition of the gas type using a pattern recognition method of principal component analysis.

In the recording medium, the fire detection program may cause the computer, in a gas classification map of principal component analysis as the database, to calculate a distance $D_t$ between a response Y of the sensor apparatus and the center of cluster of burning gas, compare the distance $D_t$ with an immediately previous distance $D_{t-1}$, if $D_t<D_{t-1}$, increment a flag S by 1, if $D_t>D_{t-1}$, reset the flag S to 0, repeat this procedure several times, and when S exceeds a reference number of times M, and recognize response Y of the sensor apparatus approaching the cluster of burning gas to recognize a fire.

According to the sixth aspect of the present invention, a recording medium recorded with data for detecting a fire by a computer, the data may be obtained by processing resonance frequency changes of each of a plurality of quartz crystal microbalances, which different films are formed on the surfaces respectively, according to mass changes of the detected burning gases or water vapor on the films.

Since, in the present invention with the above arrangement, a humidity change in the initial stage of a fire is perceived and sensed, a high-sensitivity fire detection can be achieved which has been impossible with the prior art fire detector.

Further, the present invention can provide a relatively inexpensive fire detection apparatus by using an inexpensive quartz crystal microbalance. Still further, the present invention can positively sense a fire since it recognizes a fire from humidity changes at a plurality of positions. Yet further, with the present invention, more positive fire detection is possible since it senses generation of a burning gas using sensor response varying with time.

These and other objects, effects, features, and advantages of the present invention will become more apparent from the following description of the preferred embodiments taken in conjunction with the accompanying drawings.

DETAILED DESCRIPTION OF PREFERRED EMBODIMENTS

Figure 1:
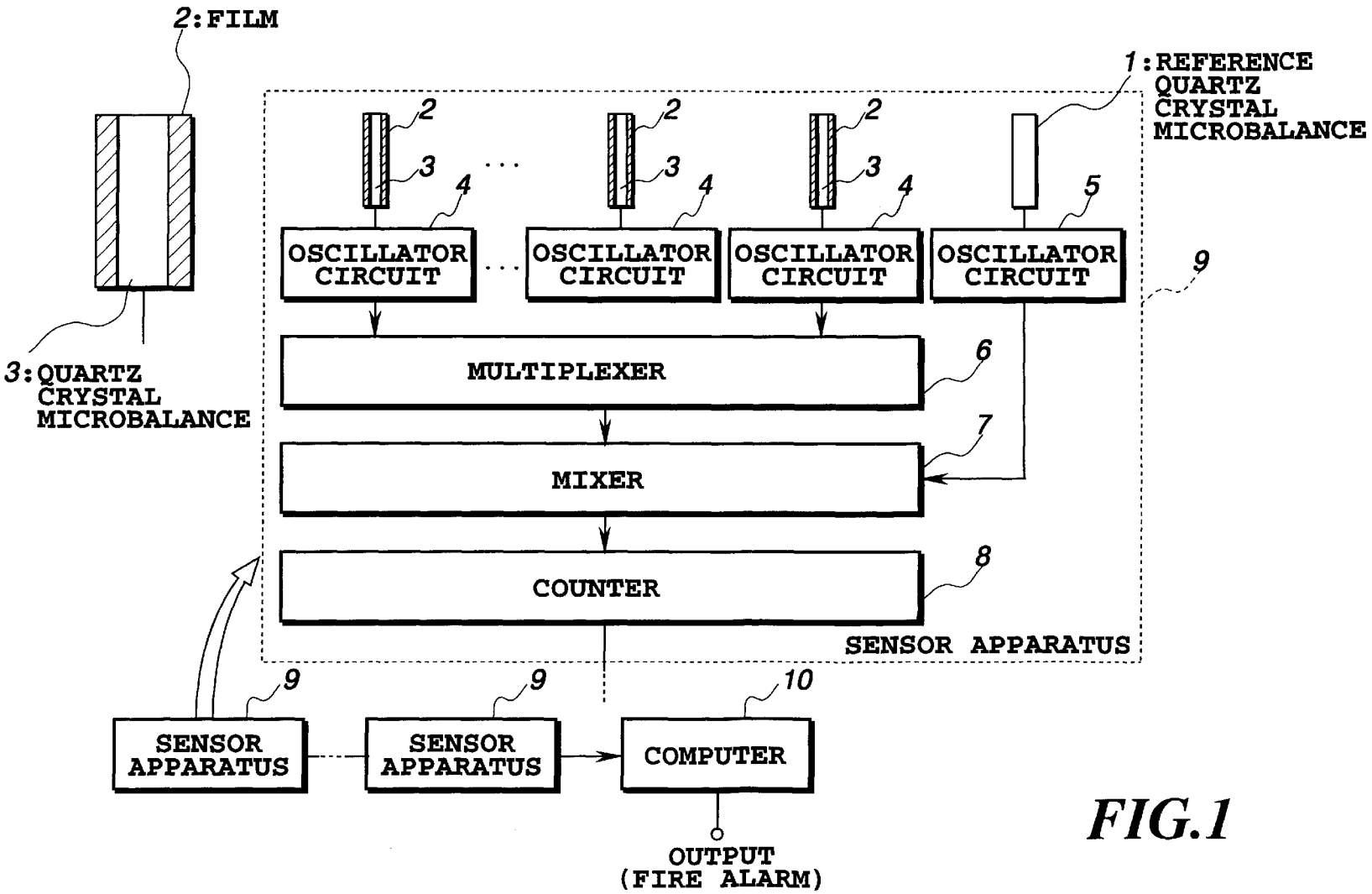
FIG. 1 is a block diagram showing the structure of the fire detection apparatus according to an embodiment to which the present invention is applied.

In the following, embodiments of the present invention will be described in detail with reference to the drawings.

[Brief description]

First, the principle and outline of the embodiments of the present invention will be described. The present invention has been accomplished through intensive studies of the inventors on adsorption of a detected gas to a film particularly in the initial stage of a fire.

First, using fluorine-containing polymers and hydrocarbons such as polyethylene, polychlorotrifluoroethylene, or a mixture of polyethylene and polytetrafluoroethylene, or amino acids such as phenylalanine, or sugars such as glucose as a target, a film is formed on a quartz crystal microbalance by radio-frequency sputtering, and changes in resonance frequency due to adsorption to these films of burning gas of a PVC (polyvinylchloride) cable and burning gas of a circuit board have been investigated.

It is known that resonance frequency change of a quartz crystal microbalance is proportional to a change in mass of the film, that is, mass of a sensed gas adsorbed. Therefore, the quartz crystal microbalance formed with a film cam be regarded as a sensor for detecting a gas. Although these gas sensors are sensitive to gases not contained in normal atmosphere, such as hydrogen chloride contained in burning gas, they are also sensitive to a water vapor. Therefore, by a single sensor, it is impossible to distinguish whether a burning gas is detected or a water vapor is detected.

Specifically, in the present invention, the sensor apparatus comprises a set of L units (L being an integer of 2 or more) of quartz crystal microbalances coated with different films, that is, sensors differing in gas adsorption characteristics. Changes in resonance frequencies $w_1, w_2, \ldots, w_L$ of the respective quartz crystal microbalances at a time are divided by square root of sum of square resonance frequency changes of the quartz crystal microbalances $$X=\sqrt{w_1^2+w_2^2+\ldots+w_L^2},$$

that is, a normalized value of resonance frequency changes of the respective quartz crystal microbalances is determined to obtain a L-dimensional data:

$$Y=(w_1/X, w_2/X, \ldots, w_L/X).$$

The L-dimensional data Y is hereinafter referred to as response Y of the sensor apparatus.

Distribution of response Y of the sensor apparatus as the multidimensional (L-dimensional) data is converted to distribution of low-dimensional data without missing information as possible by principal component analysis (See Okuno, Kume, Haga, and Yoshizawa, "Multivariate Method", NIKKA GIREN, 1971) which is one of pattern recognition methods, and the result is plotted on a gas classification map. The practical procedure is as follows:

For L-dimensional data $(w_1/X, w_2/X, \ldots, w_L/X)$, principal component Z is defined as:

$$Z=\alpha_1\times(w_1/X)+\alpha_2\times(w_2/X)+\ldots+\alpha_L\times(w_L/X).$$

In principal component Z, one which satisfies $$\alpha_1^2+\alpha_2^2+\ldots+\alpha_L^2=1 \quad (1)$$

and dispersion thereof is the maximum is defined as a first principal component. One which satisfies formula (1) and non-correlated with the first component and whose dispersion is the maximum is defined defined as a second principal component.

Figure 5:
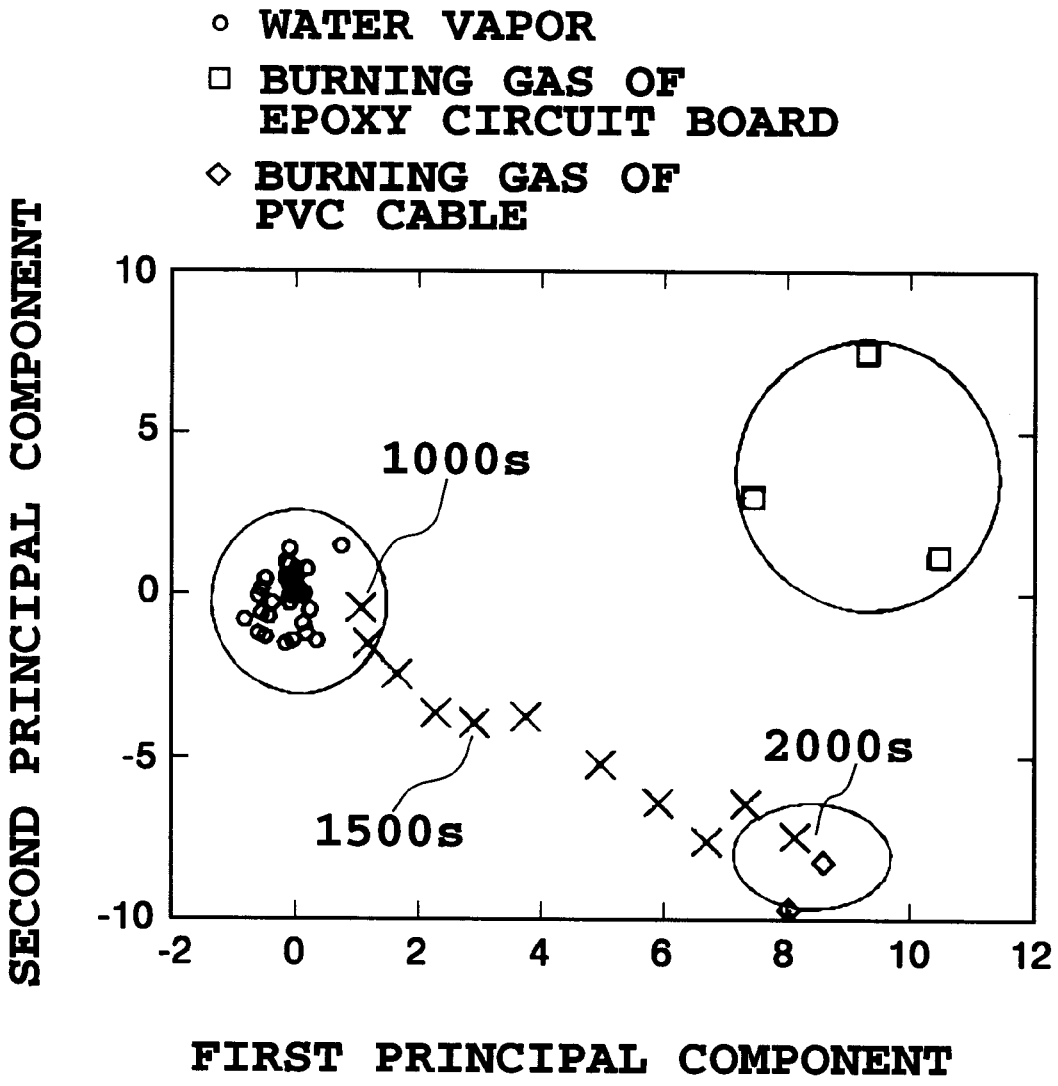
FIG. 5 is a gas classification map by principal component analysis of responses of the sensor apparatus to water vapor, to burning gases generated by heating a PVC cable, and to burning gases generated by heating an epoxy circuit board.

Using this method for known gases and water vapor, when response Y of the sensor apparatus is plotted on a gas classification map, response Y of the sensor apparatus is plotted in cluster form at a specific position on the gas classification map according to the type of the gas and a water vapor. FIG. 5 is an example of the gas classification map, while detail thereof will be described in a practical example later, a water vapor, burning gas of PVC cable and burning gas of epoxy circuit board are respectively plotted at specific positions. That is, the gas classification map are a database for recognizing gas types. The cluster data on the gas classification map can be stored in a recording medium such as a floppy disk or a CD-ROM. Response Y of the sensor apparatus to unknown gases including a water vapor can be plotted on the gas classification map to recognize gas types from which plot is close to which cluster.

If a humidity increase is detected using the above sensor apparatus, early detection of a fire is possible. A fire, however, cannot be recognized by simply detecting a humidity increase since a water vapor is contained in ordinary atmosphere. However, since ordinary humidity change is slower than humidity change occurring in a fire, ordinary humidities at a plurality of positions may be regarded to be the same. When a local humidity change occurs due to a fire, humidities at a plurality of positions are not the same. That is, N units of the above sensor apparatus are placed at positions to be fire detected to monitor humidities at the N positions. If all of the N positions are of the same humidities, it is a normal state. If even an area has a high humidity, it can be recognized as a fire point. As described above, by monitoring humidities at a plurality of positions, a recognition is possible as to whether it is a humidity change by a fire or a humidity change by a non-fire.

EMBODIMENT 1

[Apparatus construction]

FIG. 1 shows the structure of an embodiment of fire detection apparatus according to the present invention. As a sensor for detecting a fire, it uses a reference quartz crystal microbalance 1 and a plurality of L units of gas detection quartz crystal microbalances 3 provided with a film 2 on the surface. Resonance frequencies of these quartz crystal microbalances 1 and 3 are 9 MHz as an example. The gas detection quartz crystal microbalances 3 can be mounted up to 8 units, and the respective films 2 are different in materials and fabrication conditions to change the adsorption characteristics from each other. Further, the gas detection quartz crystal microbalances 3 and the reference quartz crystal microbalance 1 are provided with oscillator circuits 4 and 5, respectively, so that the oscillator circuits 4 and 5 oscillate at resonance frequencies of corresponding gas detection quartz crystal microbalances 3 and the reference quartz crystal microbalance 1.

A multiplexer 6 selects one of the oscillator circuits 4. A mixer 7 outputs a signal having a frequency of a frequency difference between outputs of the selected oscillator circuit 4 and the oscillator circuit 5. A counter 8 measures frequency of this output signal of the mixer 7.

A plurality of sensor apparatuses 9 comprising the above elements from 1 to 8 can be connected to a computer 10 using an interface such as RS485 (not shown) which is possible to make long distance communications and monitor humidities in a plurality of areas, followed by data processing. As the computer 10, a general personal computer or the like can be applied.

[Entire operation of the apparatus]

Next, operation of the fire detection apparatus shown in FIG. 1 will be described. When the respective oscillator circuits 4 and 5 are made operative, the gas detection quartz crystal microbalances 3 and the reference quartz crystal microbalance 1 begin to oscillate. When a gas is generated, the gas is adsorbed to the film 2 on the respective gas detection quartz crystal microbalances 3, resonance frequencies of the respective gas detection quartz crystal microbalances 3 are shifted according to the mass changes, thereby shifting the resonance frequencies of the respective oscillator circuits 4. The amount of the shift of resonance frequency is proportional to mass of the detected gas adsorbed to the film 2 of each gas detection quartz crystal microbalance 3.

The multiplexer 6 selects any one of the oscillator circuits 4 in a certain period, for example, at every one second, the mixer 7 outputs a signal having a frequency difference between outputs of the selected oscillator circuit 4 and the reference oscillator circuit 5. Since the resonance frequency of the reference quartz crystal microbalance 1 connected to the oscillator circuit 5 is always constant, the mixer 7 outputs a signal having a frequency proportional to the mass of a gas adsorbed to the film 2 on the gas detection quartz crystal microbalance 3.

Since the counter 8 measures frequency of this output signal, it finally outputs the mass of the gas (specifically, number of counts corresponding to the mass of the gas) adsorbed to the film 2 on the gas detection quartz crystal microbalance 3. By selecting the oscillator circuits 4 periodically by the multiplexer 6, the mass of the gas adsorbed to the film 2 on the respective gas detection quartz crystal microbalances 3 can be outputted. These sensor apparatuses 9 are disposed in N areas (N being an integer of 2 or more), and outputs of the respective sensor apparatuses 9 are monitored by the computer 10.

The sensor apparatus 9 disposed in an area i (i being an integer from 1 to N) detects a gas, and the gas is recognized using the existing pattern recognition method such as the above-described principal component analysis. If no gas is detected, flag $f_i=0$ is set. When a gas is recognized as a water vapor, $f_i=1$ is set. If not, $f_i=0$ is set.

As described above, the N areas are monitored and $$J=f_1+f_2+\ldots+f_N$$

is calculated, and if $0<J<N$, it is recognized that an area where $f_i=1$ is highly possible to be a fire. When J=0 or J=N, it is recognized as a non-fire since it is possibly due to detection of a gas other than a water vapor such as alcohol or an ordinary humidity change.

More preferably, when a humidity increase is detected as above and it is recognized as highly possible to be a fire, a distance $D_t$ between response Y of the sensor apparatus 9 and the center of gravity of cluster of burning gas are calculated in a gas classification map such as principal component analysis. $D_t$ and immediately previous distance $D_{t-1}$ are compared, and if $D_t<D_{t-1}$, flag S is incremented by 1. If $D_t>D_{t-1}$, flag S is reset to 0. This procedure is repeated several times, when S exceeds a reference number of times, response Y of the sensor apparatus 9 is recognized to approach the cluster of burning gas, thereby making more positive fire recognition.

[Control procedure]

Figure 2:
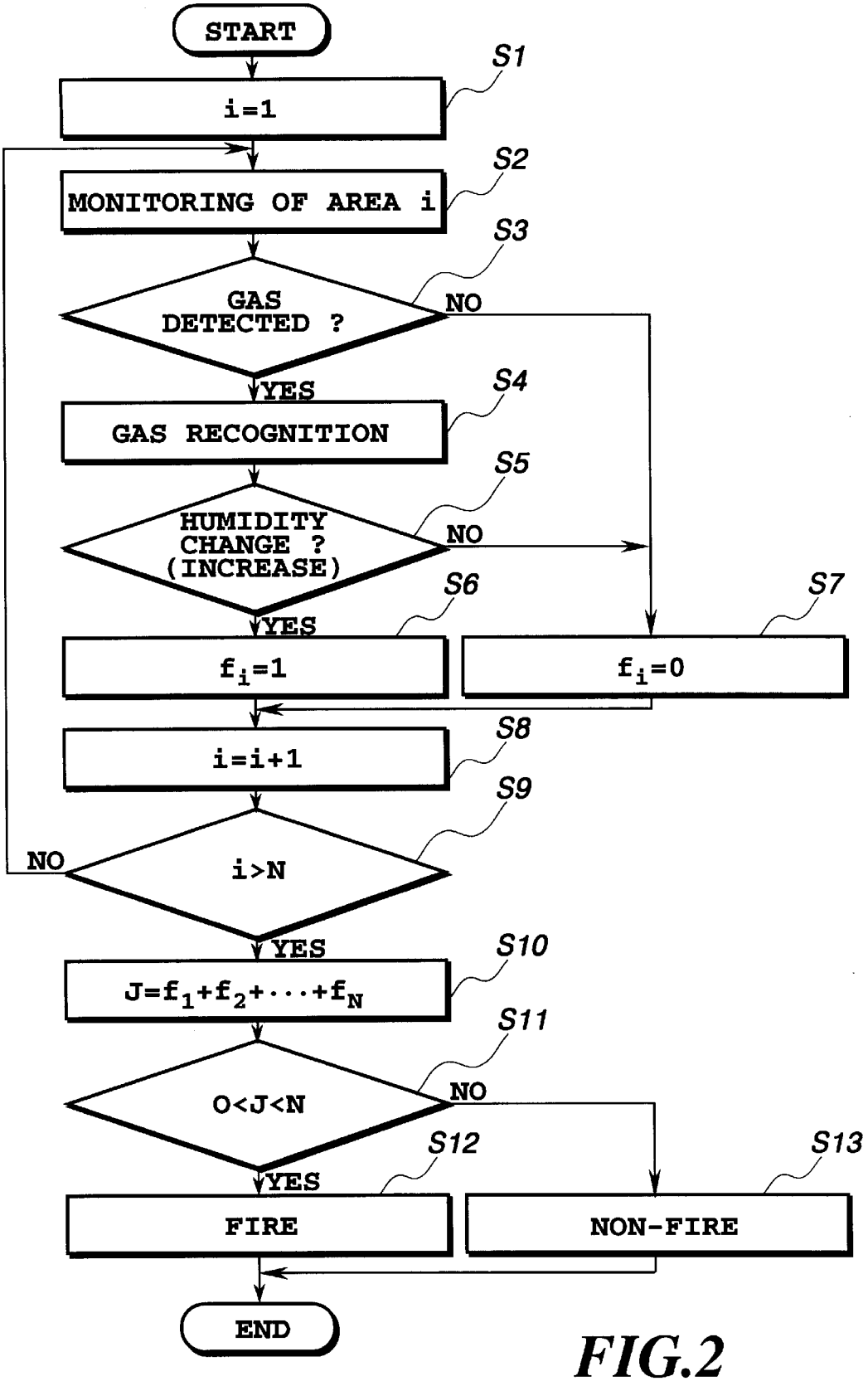
FIG. 2 is a flow chart for explaining the fire detection method according to an embodiment of the present invention.
Figure 3:
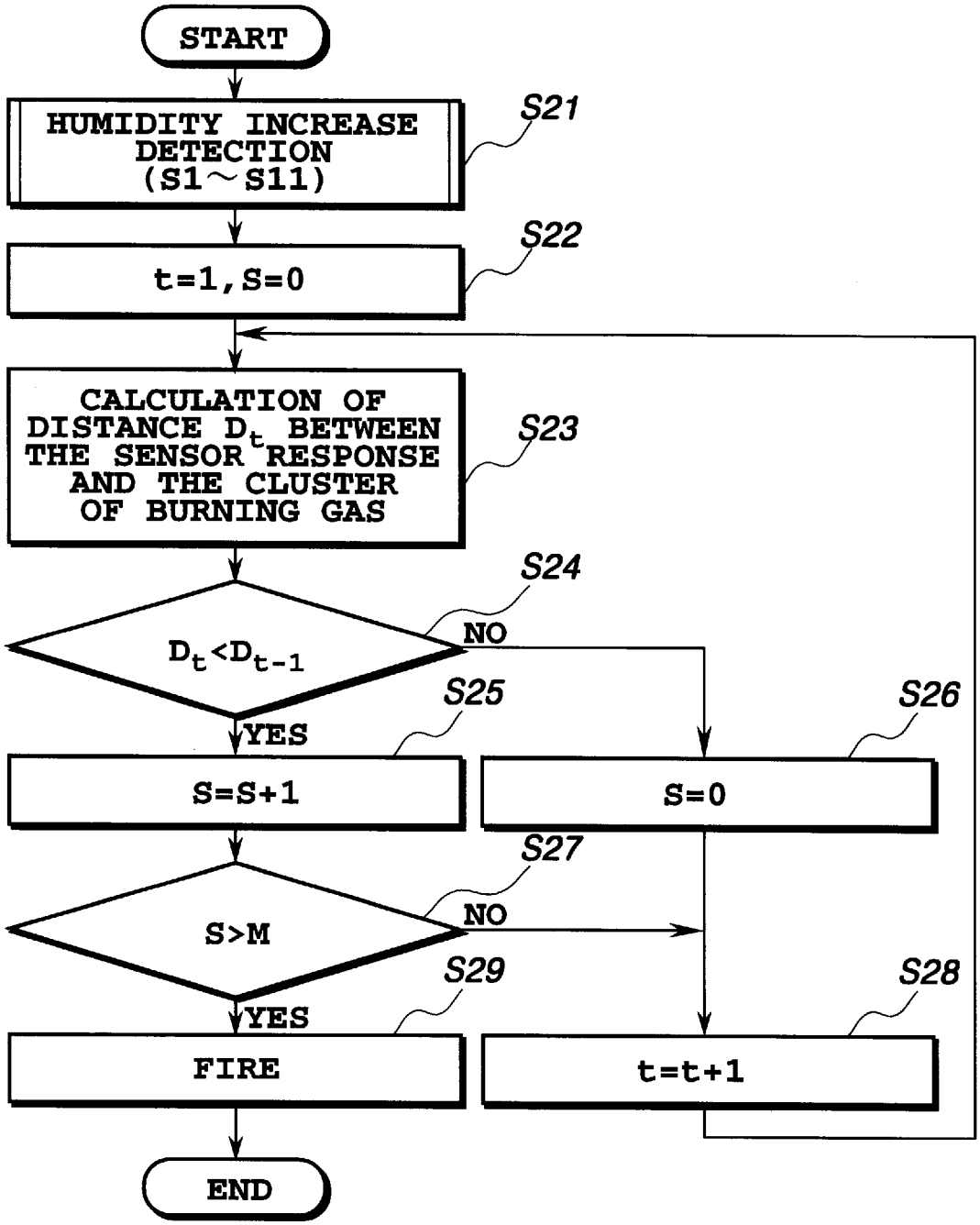
FIG. 3 is a flow chart for explaining a method, when a gas is recognized as a water vapor by the fire detection method according to an embodiment of the present invention, for positively recognizing whether it is an ordinary humidity change or a fire.

Next, practical calculation control procedure of the computer 10 of the fire detection apparatus of FIG. 1 will be described with reference to flow charts of FIGS. 2 and 3. The procedures of FIGS. 2 and 3 are written in the form of programs in an internal memory of the computer 10 for execution, and can be stored in a recording medium such as a floppy disk or a CD-ROM.

First, the procedure of FIG. 2 executed by the computer 10 will be described.

First, initial setting of area i to i=1 is made (S1).

Next, output of the sensor apparatus 9 disposed in the area i is monitored (S2). A recognition is made as to whether or not a gas is detected according to output signal of the sensor apparatus (S3). When it is recognized that no gas is detected, flag $f_i$ is not set (to be $f_i$=0) (S7).

When a gas is detected in S3, since the gas type is normally unknown, response Y of the sensor apparatus is analyzed to recognize the gas type using principal component analysis (S4). As a result of gas recognition, when it is a water vapor (humidity increase) (S5), flag $f_i$ is set (to be $f_i$=1) (S6). However, if it is ethanol contained in alcohol or the like, flag is not set (to be $f_i$=0) (S7).

Next, area i is incremented by 1 (i=i+1) (S8). Where the number of areas to be monitored is N, if i<N, the above processing is repeated according to S2 (S9).

Since humidity changes even not from a fire, if humidity increases of all of a plurality of areas are sensed, it can be regarded as humidity increases due to a non-fire, and if a humidity increase only in an area is sensed, it can be regarded as a humidity increase due to a fire. That is, where the number of monitored areas is N, and flag of an area i is $f_i$, $$J=f_1+f_2+\ldots+f_N$$

is calculated (S10), if 0<J<N (S11), it is recognized that area i where flag $f_i$ is 1 is highly possible to be a fire, and a fire alarm is generated (S12). If not 0<J<N, that is, when J=0 or J=N, it is recognized to be a non-fire, and a fire alarm is not generated (S13).

Recognition criteria of J can be varied depending on the area of the place to be fire detected, or how many false reports due to malfunction of the sensor apparatus are decreased. That is, when the sensor apparatus malfunctions, the flag of the area may be always 0, under which condition normal humidity increase is recognized to be a fire with the recognition criteria of 0<J<N. In such a case, false reports can be reduced by changing the recognition criteria of S11, for example, to 0<J<N−1.

As another case, depending on the type of malfunction, flag $f_i$ may always be 1. In such a case, false reports can be reduced by changing the recognition criteria of S11 to 1 <J<N−1. The fire detection sensitivity is, however, decreased.

As described above, since reduction of false report and improvement of fire detection sensitivity are in a trade-off relation, recognition criteria of J is determined from even balance of loss due to false report and loss due to a fire.

EMBODIMENT 2

A humidity increase occurs in the initial stage of a fire. As the fire advances, burning gases are generated such as hydrogen chloride gas from a PVC cable. The burning gas can be detected to make fire recognition more positive. When a humidity increase is detected, it is possible to recognize that it is a normal humidity increase or a humidity increase due to a fire, by investigating how the response Y of the sensor apparatus 9 varies with time. The move positive five recognition methods will be described below with reference to the flow chart shown in FIG. 3.

When recognizing the gas type using the above-described principal component analysis, a distance between the response Y of the sensor apparatus 9 and the center of gravity of cluster of a known burning gas or a water vapor on a gas classification map of database previously stored in an internal memory of the computer 10, does not always provide right judgements. If the response Y of the sensor apparatus 9 approaches the cluster of burning gas and it is still closer to the cluster of a water vapor, it is recognized as a water vapor. When it approaches the cluster of burning gas, even if it is close to the cluster of a water vapor, burning gas should be detected.

Then, the computer 10 detects a humidity increase in a gas classification map such as principal component analysis by executing the steps of S1 to S11 of FIG. 2. When 0<J<N gives an affirmative recognition and a fire is suspected, it is not recognized as a fire immediately (S21), t and S are initially set to t=1 and S=0, respectively (S22)

Next, distance $D_t$ between the response Y of the sensor apparatus 9 and the center of the cluster of burning gas is calculated (where t is number of recognition times) (S23).

$D_t$ and immediately previous distance $D_{t-1}$ are compared, if $D_t<D_{t-1}$ (S24), flag S is incremented by 1 (S25). If $D_t>D_{t-1}$, S is reset to 0 (S26). That is, it is recognized as to whether response Y of the sensor apparatus 9 continuously approaches the cluster of burning gas. This procedure is repeated several times. When S exceeds a reference number of times (S27), it is recognized that response Y of the sensor apparatus 9 approaches the cluster of burning gas, and a fire is recognized to generate a fire alarm (S29).

By the above processing, when a humidity increase is detected, it can be positively recognized whether it is a normal humidity increase or due to a fire. Although not shown in the figure, it is preferable that in the flow in FIG. 3, a maximum value T of recognition number of times t is previously set, and when t>T is reached, the processing is separated from the loop of FIG. 3 to complete the present processing.

[Experimental result: No. 1]

Next, measurement results based on the above-described embodiments 1 and 2 will be described.

First, each one of the sensor apparatus was disposed on the ceiling in a laboratory (sensor A) and outside the laboratory (sensor B). Therefore, N=2 in this case.

Figure 4:
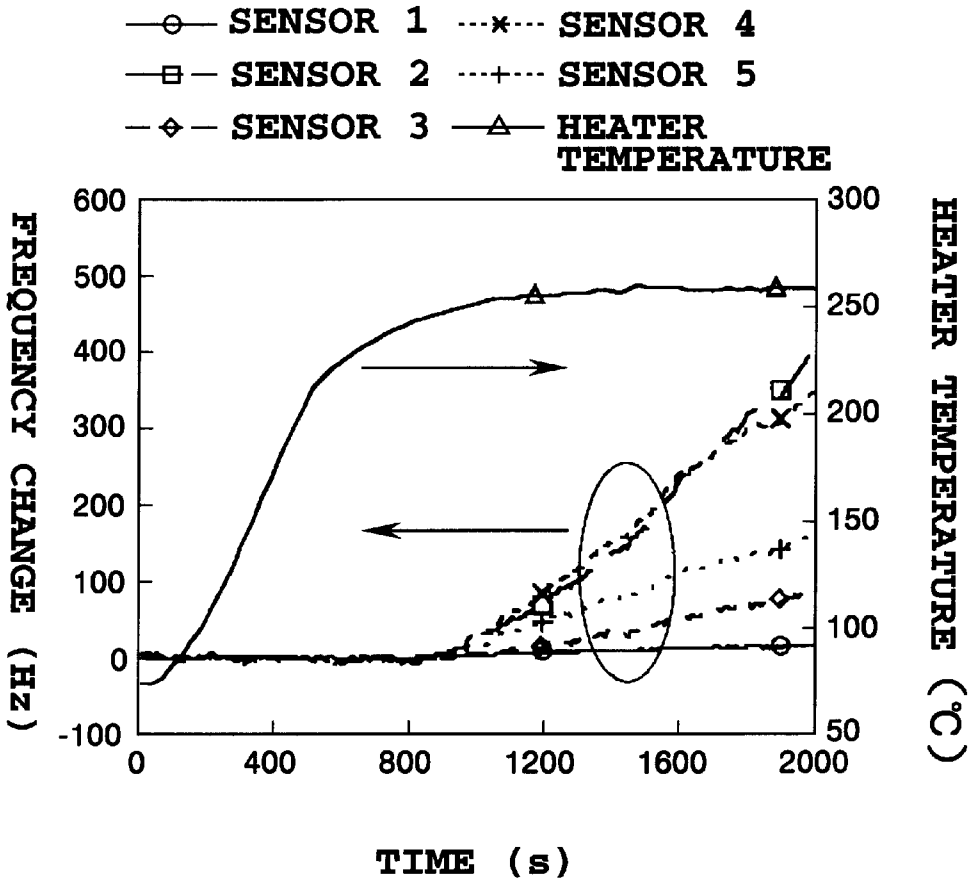
FIG. 4 is a diagram showing resonance frequency changes of five quartz crystal microbalances in a sensor apparatus and heating temperature changes for the generated gas when a communication PVC cable is heated.

FIG. 4 shows how frequency change of each quartz crystal microbalance of sensor A varies with time. The axis of ordinates indicates a frequency change of the quartz crystal microbalance, which can be regarded as a mass change of gas. The time interval of data acquisition is 5 seconds. Temperature change of a heater is also shown. Five quartz crystal microbalances are used as sensor 1 to sensor 5. Film materials of the respective quartz crystal microbalances are: sensor 1: polychlorotrifluoroethylene, sensor 2: phenylalanine, sensor 3: polychlorotrifluoroethylene and phenylalanine, sensor 4: pyrolytic graphite, and sensor 5: glucose. After about 800 seconds from the beginning of the test, when the temperature of the heater begins saturate at 250° C., resonance frequency of each quartz crystal microbalance begins to change.

In this experiment, the PVC cable is just softened, and no visible smoke is not generated, corresponding to an initial fire which cannot be detected by a smoke detector. As shown, it can be seen that the fire detection apparatus of the present invention is possible to provide more sensitive fire detection than prior art fire detectors, if it is a fire providing a humidity increase at an early stage.

FIG. 5 shows response to a water vapor, response to gases generated by heating a PVC cable, and response to gases generated by heating an epoxy circuit board, plotted on a gas classification map by principal component analysis. Concentrations of the water vapor are those at relative humidities of 3% to 70%. The PVC cable and the epoxy circuit board were heated at 200° C. to 260° C. in a test room, and responses to the generated gases were measured. Parameter used in the principal component analysis, as described above, is a value of resonance frequency change of each quartz crystal microbalance $w_1, w_2, \ldots, w_L$ divided by $$X=\sqrt{w_1^2+w_2^2+\ldots+w_L^2},$$

that is, a normalized value of resonance frequency change of each quartz crystal microbalance. Response Y of the sensor apparatus can be plotted on the gas classification map of FIG. 5, and gas be recognized from plot thereof is close to which cluster.

Time interval of making the gas recognition is 100 seconds. After beginning measurement in FIG. 4, responses Y of the sensor apparatus from 1000 seconds to 2000 seconds are plotted by mark X at every 100 seconds in FIG. 5. Responses Y of the sensor apparatus after 1000 seconds are plotted at the cluster of a water vapor, responses Y of the sensor apparatus after 2000 seconds are plotted at the cluster of burning gas of PVC cable.

It can be seen from FIG. 5 that a water vapor is generated from the PVC cable at an initial stage of heating and, as the heating temperature increases, burning gas specific to the PVC cable is generated. In this experiment, threshold value of gas detection is set to 20 Hz in an average value of resonance frequency change of the quartz crystal microbalance. Threshold value of gas detection determines the sensitivity of fire detection. After 1000 seconds from the beginning of experiment, average value of resonance frequency change of quartz crystal microbalance exceeds 20 Hz and in the stage of detecting the humidity increasing, $f_1=1$. Since the sensor apparatus B disposed outside the laboratory is not contacted with burning gas, resonance frequency change of the quartz crystal microbalance was nearly 0. Therefore, $f_2=0$, in this case, N=2, $f_1=1$, $f_2=0$, J=1, and 0<J<N, it can be recognized that a fire occurs in the laboratory (see S11 of FIG. 2).

After 1000 seconds from the beginning of measurement, it is recognized as a water vapor and distance $D_t$ between the response Y of the sensor apparatus and the center of the cluster of PVC cable burning gas was calculated one by one. The center of cluster in this case is the middle point (9.3,−9.0) of two points of data of PVC cable burning gas in the gas classification map of FIG. 5. Response Y of the sensor apparatus in the two-dimensional gas classification map gradually approaches the cluster of PVC cable burning gas, at the point of 1300 seconds from the beginning of measurement, where M is 3 in S27 of the flow chart of FIG. 3, S>M is established, and a fire is thus recognized.

[Experimental result: No. 2]

Figure 6:
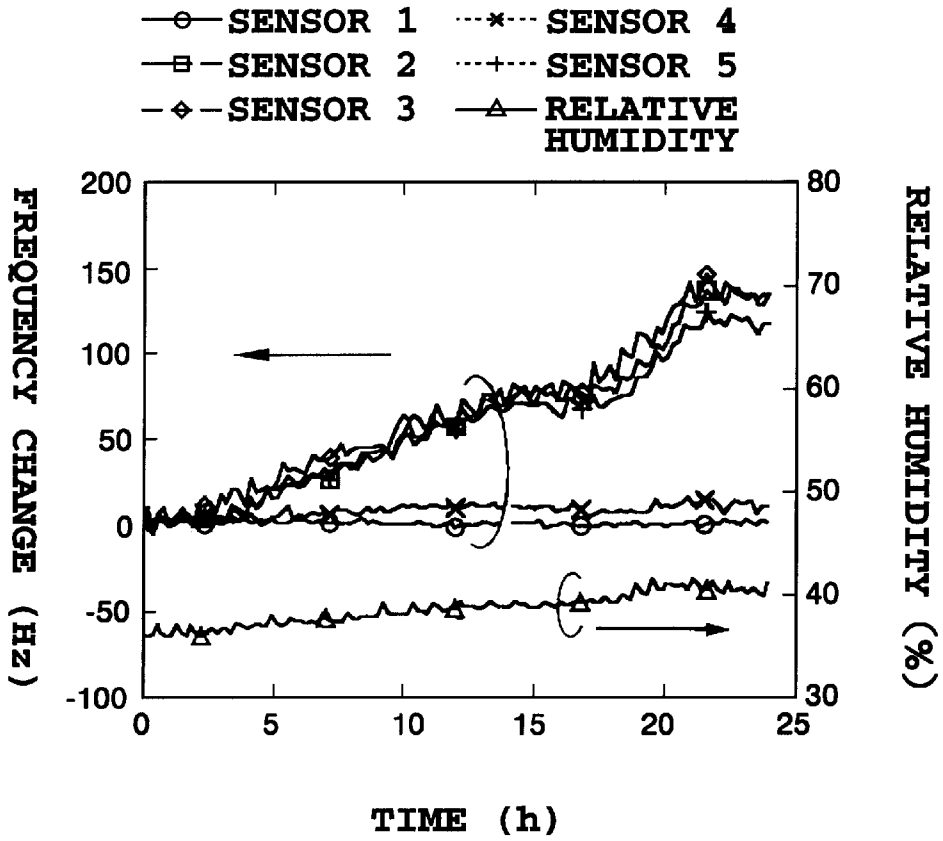
FIG. 6 is a diagram showing resonance frequency changes of a quartz crystal microbalance for 24 hours of a sensor apparatus A disposed in a computer room.
Figure 7:
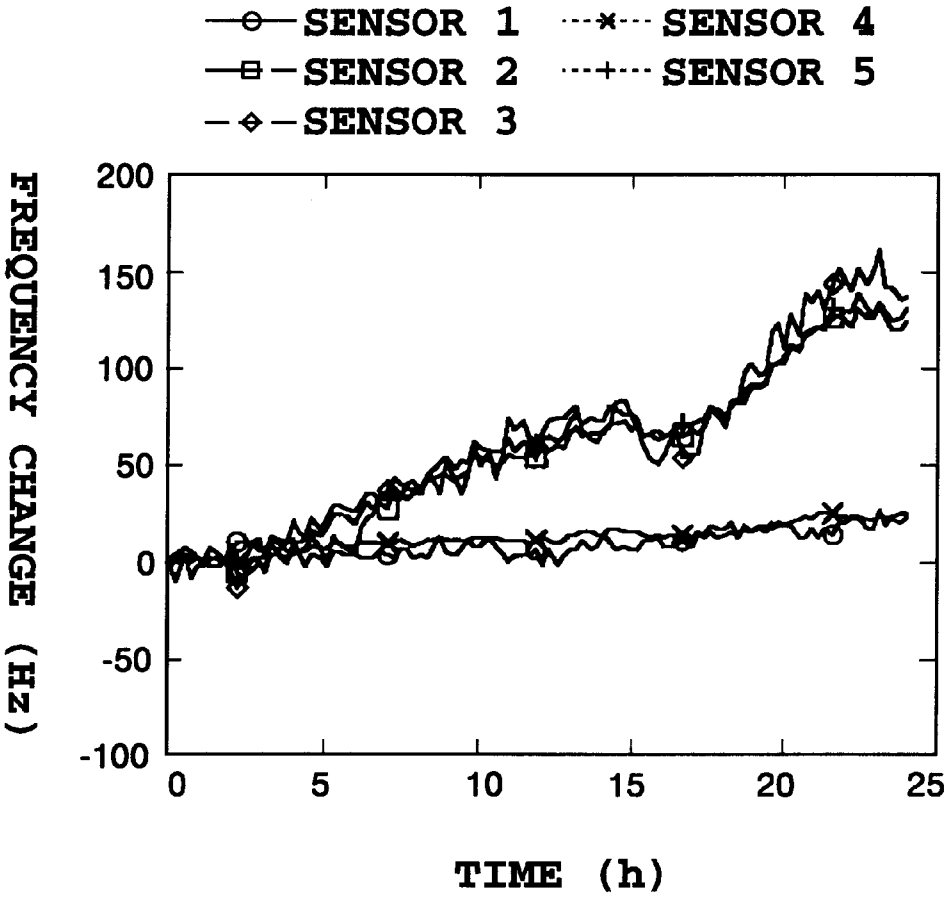
FIG. 7 is a diagram showing resonance frequency changes of a quartz crystal microbalance for 24 hours of a sensor apparatus B disposed in a computer room.

When the sensor apparatuses A and B are disposed about 30 m apart from each other in a computer room and are monitored for 24 hours, resonance frequency changes of quartz crystal microbalance sensors of the respective sensor apparatuses are shown in FIG. 6 and FIG. 7, respectively. Since any fire does not occur in the computer room in this period, the obtained resonance frequency change of the quartz crystal microbalance sensor is due to a humidity change. In FIG. 6, relative humidity is also shown. Resonance frequency change of the quartz crystal microbalance sensor of the sensor apparatus A is high in correlation with relative humidity, which shows that the quartz crystal microbalance sensor responds to the humidity change. Further, FIG. 7 closely resembles FIG. 6, showing that the sensor apparatus B of FIG. 7 also responds to humidity changes.

Figure 8:
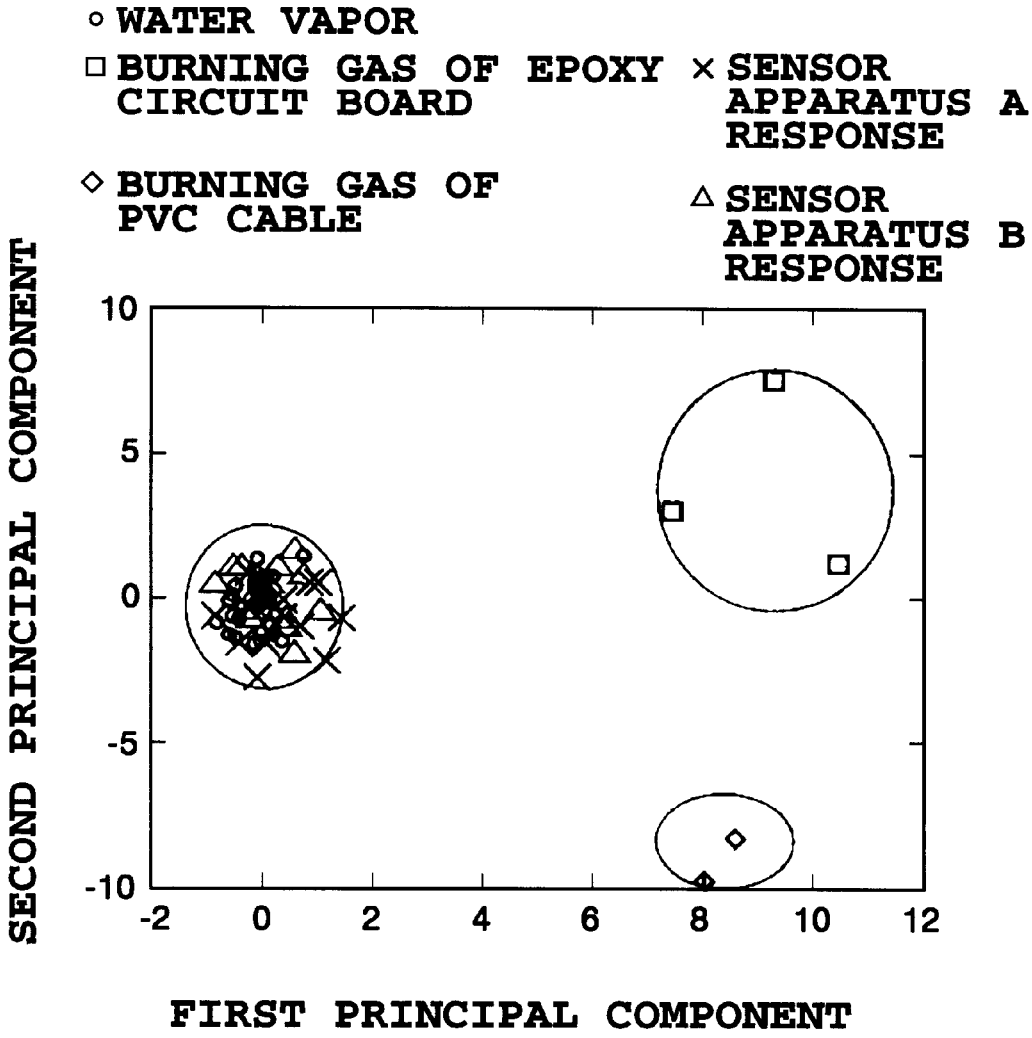
FIG. 8 is a gas classification map plotting principal component analysis of resonance frequency changes of a quartz crystal microbalance showing those exceeding 20 Hz in average values in responses of sensor apparatuses A and B in the computer room.

FIG. 8 shows data exceeding 20 Hz in average value of resonance frequency change of the quartz crystal microbalance sensor, selecting 10 points at the same time for the sensor apparatuses A and B, determined for response Y of the sensor apparatuses for A and B, and plotted on a gas classification map using principal component analysis. For both the sensor apparatuses A and B, timing of exceeding an average value 20 Hz was the same. X mark is a response of the sensor apparatus A determined from FIG. 6, and Δ mark is a response of the sensor apparatus B determined from FIG. 7. Both responses are plotted in water vapor clusters, and thus recognized as a water vapor. In this case, from N=2, $f_1=f_2=1$, J=2, and J=N, it was recognized to be a non-fire.

Further, also in this case, distance $D_t$ between the response of the sensor apparatus and the center of the cluster of PVC cable burning gas and the cluster of epoxy circuit board burning gas was calculated one by one. The center of the cluster of epoxy circuit board is the center of gravity (9.5, 4.6) of three points of data of epoxy circuit board burning gas. Responses of both the sensor apparatuses did not approach to the cluster of the PVC cable burning gas or the cluster of the epoxy circuit board burning gas. When M was set to 3 in S27 of the flow chart of FIG. 3, S<M was always established, and no fire was recognized.

[Other embodiments]

Figure 9:
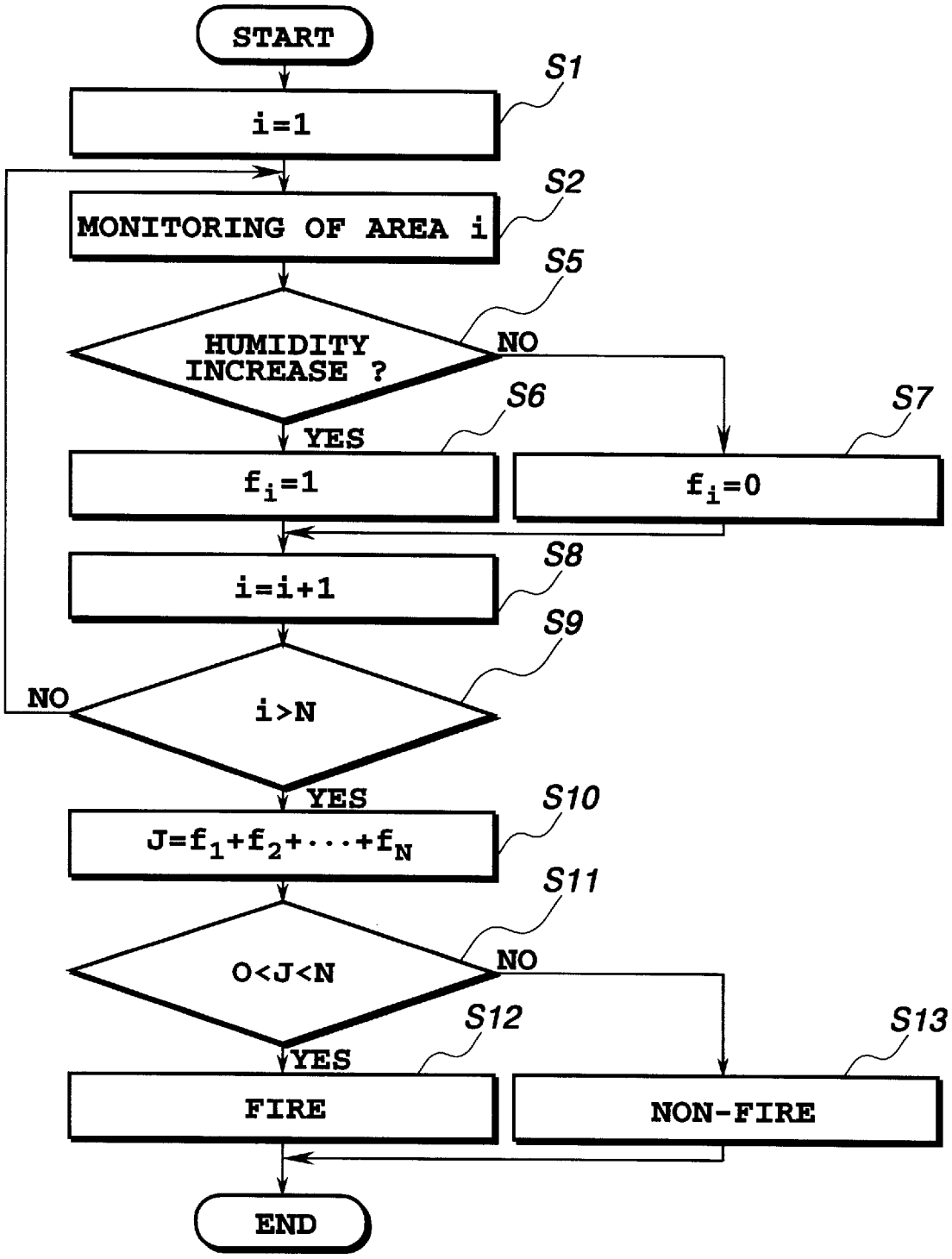
FIG. 9 is a flow chart showing operation procedures in another embodiment of the present invention.

The above-described embodiments are described for cases using the quartz crystal microbalance type sensors as humidity change detection means. The present invention, however, is not limited to the embodiments, as humidity change detection means, it is apparent that a fire can also be detected using other humidity change detection sensors such as known electrostatic capacitance method, electrical resistance method, or electrolytic method for monitoring humidities of a plurality of positions in a place to be detected for a fire. An example of flow chart for detecting a humidity change due to a fire in this case is shown in FIG. 9. Procedure of FIG. 9 is based on the procedure of FIG. 2, from which the processings of S3 and S4 are eliminated, and since other processings are the same, detailed description thereof is omitted.

EMBODIMENTS 3 & 4

A third embodiment of the present invention is a formation method of a polymer thin film used in the above-described detection sensor, and a fourth embodiment relates to a chemical sensor probe, more specifically to a formation technology of a polymer thin film using a hydrocarbon as a basic structure which is superior in adhesiveness to the substrate and film thickness controllability and to a chemical sensor probe using the polymer thin film.

The polymer thin film according to the third embodiment of the present invention is characterized in that it is formed by a polymer thin film formation method in which a thin film is formed by radio-frequency sputtering of a sputtering target, and a sintered polymer formed by hot-pressed granules of hydrocarbon polymers having particle diameters ranging from 50 to 200 micrometers is used as a sputtering target.

The chemical sensor probe according to the fourth embodiment of the present invention is formed by sputtering a sintered polymer formed by hot-pressing granules of hydrocarbon polymers having particle diameters ranging from 50 to 200 micrometers, thereby providing a polymeric granularthin film constituting of carbon, hydrogen, and oxygen atoms, and having an oxygen content within a range from 2 to 20% on a piezoelectric mass transducer.

In accordance with the third embodiment of the present invention, in a radio-frequency sputtering method for making polymer thin film by radio-frequency sputtering a sputtering target, a sintered polymer having a particle diameter of 50 to 200 $\mu$m is used as a sputtering target.

When an ordinary polymer desk is used as a target we can not obtain the films. This is probably due to the decomposition of molecular networks by high-energy particles. Suppressing the decomposition induced by cleavage of these carbon—hydrogen bonds is a key point of preparing hydrocarbon-based polymer thin films. Then, by using a sintered polymer as a target, primary sputtering beam can penetrate into the bulk inside through the target surface. In this case, by using a sintered polymer constituting of granules (with diameter of 50 to 200 $\mu$m), an average spacing of target particles is about 20 $\mu$m. Because this porous space is sufficiently smaller than the mean free path, the energies of primary sputtering-beam are reduced by collisional scattering with particles nearer to the surface. Consequently, decomposition of the inside granules can be suppressed.

Further, the fourth embodiment of the present invention relates to a chemical sensor probe using an organic thin film formed by the aforementioned organic thin film preparation method. The sensor probe is composed of the piezoelectric mass transducer coated with a hydrocarbon-based polymer thin film containing C.H.O, and having an O atom content of 2 to 20%. When oxygen content of hydrocarbon-based polymer thin film is 2 to 20%, the thin film exhibits superior adsorption-desorption characteristics as described following embodiments as embodiments which will be shown below.

In the following, embodiments of the present invention will be shown in further detail with reference to the drawings.

Figure 10:
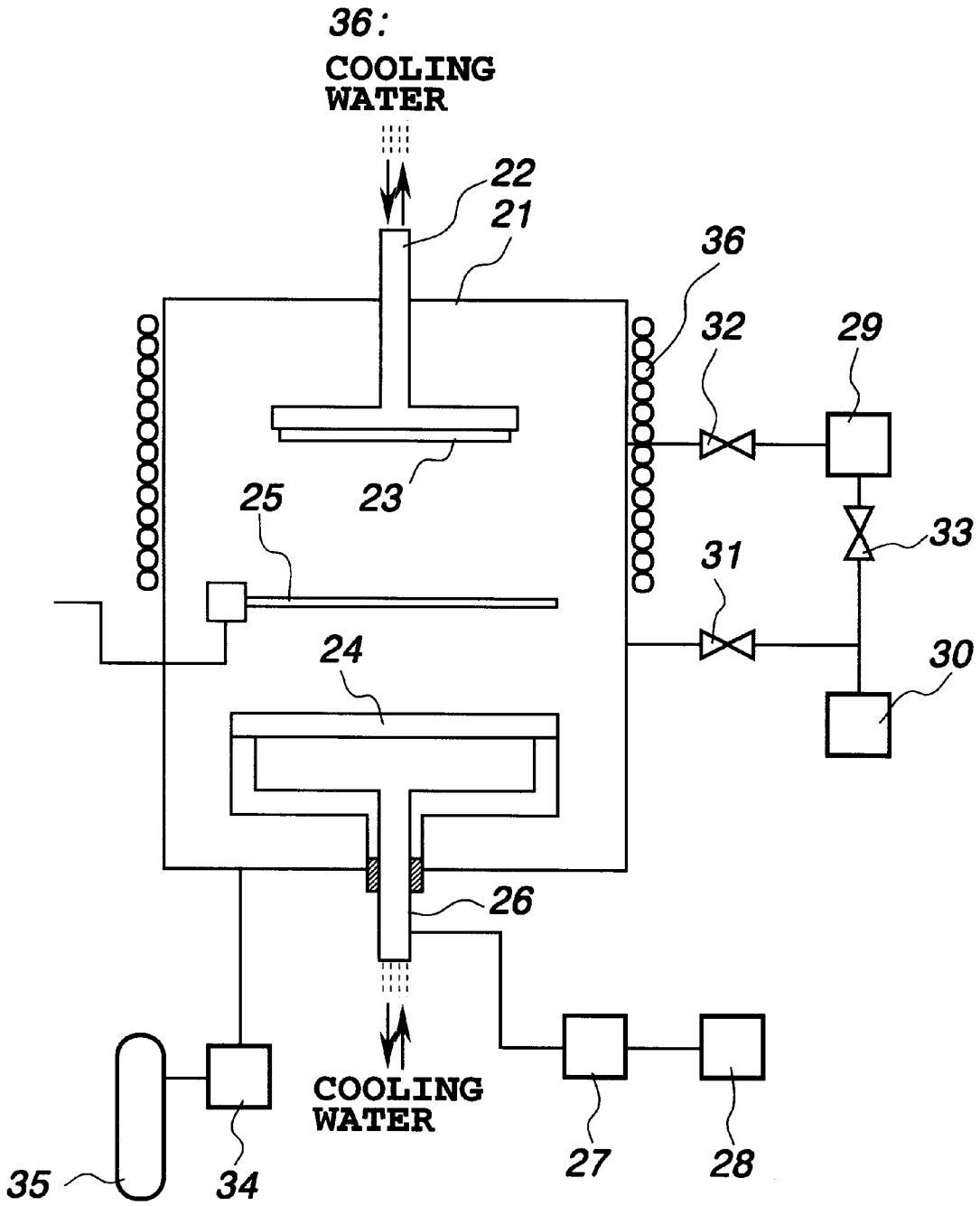
FIG. 10 is a schematic diagram of a sputtering apparatus exemplified in an embodiment of the present invention.

FIG. 10 shows an example of structure of a parallel flat plate two electrode type radio-frequency sputtering apparatus according to the third and fourth embodiments. As shown in the figure, a radio-frequency magnetron sputtering apparatus comprises a vacuum chamber 21 in which the high vacuum condition will be attained, a substrate 23, such as a mass detection transducer for chemical sensor to be film-coated, a substrate holder 22 for holding the substrate 23, a sputtering target 24 a raw material to be sputtered, a radio-frequency electrode 26 for mounting the sputtering target 24, a shutter 25 disposed between the substrate 23 and the sputtering target 24, a radio-frequency power generator 28 for applying a radio-frequency voltage to the radio-frequency electrode 26, an impedance-matching controller 27 for adjusting the radio-frequency power generator 28, an oil diffusion pump 29 for evacuating the vacuum chamber 21, an angle valve 32 for opening and closing between the vacuum chamber 21 and the oil diffusion pump 29, an angle valve 33 for evacuation for the oil diffusion pump 29, an oil rotary pump 30, an evacuation system main valve 31 for opening and closing between the vacuum vessel 21 and the oil rotary pump 30, a heater 16 for increasing evacuation efficiency from the vacuum vessel 21, a krypton gas cylinder 35, and a mass flow controller 34 for krypton gas flow for adjusting gas pressure in the vacuum chamber 21.

A polymer thin film preparation method using the above-mentioned sputtering apparatus will be described. A piezoelectric mass transducer for chemical sensor is used as a substrate 23 on the substrate holder 22. Typically a quartz crystal microbalance (AT-cut, resonance frequency of 9 MHz) can be used. Further, a silicon wafer or a borosilicate glass plate are used for film analysis. Still further, as a sputtering target 24, a sintered polymer is mounted on the radio-frequency electrode 26. The sintered polymer is formed by hot-pressing (sintering) granules of hydrocarbon-based polymers having particle diameters ranging from 50 to 200 $\mu$m. Typically, the sintered polymer is either a sintered polyethylene or a sintered polyvinylidenefluoride. An average porous spacing of these sintered polymer particles is preferred to be about 20 $\mu$m.

After the oil rotary pump 30 is operated and the angle valve 33 for evacuation for the oil diffusion pump is opened, the oil diffusion pump 29 is operated to start up the evacuation system. After the angle valve 33 for evacuation of the oil diffusion pump is closed, the angle valve 32 is opened to start evacuation. When the pressure is decreased to about $10^{-1}$ Torr, the angle valve 32 is closed, and the angle valve 33 for evacuation of the oil diffusion pump and the evacuation system main valve 31 are opened to establish high vacuum condition. Baking of the vacuum chamber 21 using the heater 36 or a liquid nitrogen trap attached to the oil diffusion pump 29 is operated to enhance evacuation efficiency, and evacuation is carried out until the gas pressure of about $7\times10^{-1}$ Torr is obtained.

After establishing high vacuum condition, krypton is introduced at a flow rate of 6 cc/min from the krypton gas cylinder 35 through the mass flow controller 34 to adjust gas pressure in the vacuum chamber 21. At this moment, a radio-frequency voltage is applied to the radio-frequency electrode 26 by the radio-frequency power supply 28 to generate a plasma. A capacitance in the matching box 27 is adjusted so that a stable plasma condition is obtained, and film preparation is carried out for the intended time. During this operation, the substrate holder 22 is preferably kept at 10° C. by cooling water 36.

Deposition rate of thin film is 8 Å/min for sintered polyethylene, and 10 Å/min for a sintered polyvinylidenefluoride.

Molecular structure of the resulting polymer thin film was analyzed by means of a Fourier transform infrared (FTIR, Nippon Bunkosha FT/IR-5M) spectrophotometer or a hydrogen forward scattering Rutherford backscattering spectrometer(HFS-RBS, Nisshin High Voltage AN-2500).

Figure 11:
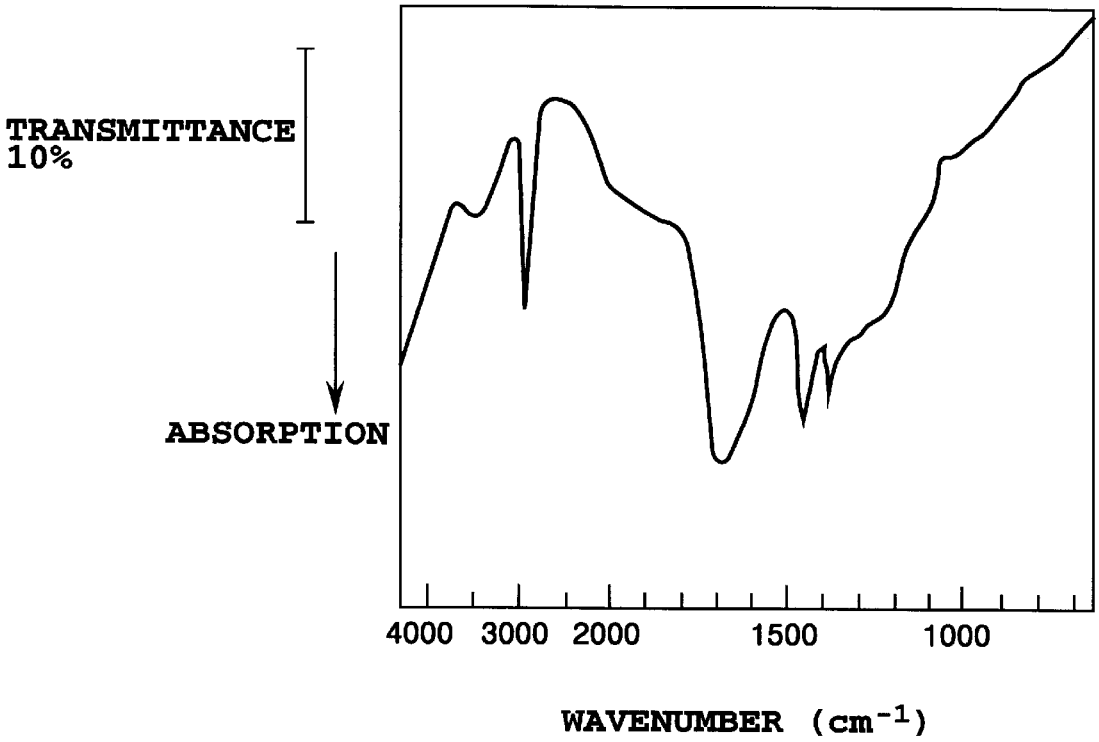
FIG. 11 is a diagram showing a Fourier transform infrared spectrum of a polyethylene thin film exemplified in an embodiment of the present invention.

FIG. 11 shows a FTIR spectrum of polyethylene thin film. A signal caused by stretching vibration of C═H bond is observed at around 2950 $cm^{-1}$, and a signal caused by bending vibration is observed at 1380 and 1450 $cm^{-1}$. Further, a broad signal caused by stretching vibration of C═C and/or C═O is observed centering at 1680 $cm^{-1}$. The C═C bond is considered to be generated by elimination of hydrogen during sputtering process, and C═O is considered to be generated by a plasma reaction of oxygen source (water or oxygen) present in the vacuum chamber with unsaturated carbon generated by elimination of hydrogen, formations of both are closely related with each other. Moreover, a broad signal caused by O—H stretching vibration is weakly observed at around 3500 $cm^{-1}$. HFS-RBS analysis revealed that film constituting elements are carbon (C), hydrogen (H), and oxygen (O), with a ratio of C:H:O= 6:3:1. And it could be confirmed that each constituting elements are uniformly distributed in the direction of the thickness of the film. Based on these analytical results, it has been clarified that a hydrocarbon-based polymer thin film can be prepared in the form of maintaining C—H bonds by suppressing decomposition of polyethylene, rather than those in the form of almost complete elimination of hydrogen atom as shown in the previous techniques.

Next, gas-sorption characteristics as a chemical sensor probe will be described. Resonance frequency of thickness-shear mode of a quartz crystal microbalance (AT-cut, resonance frequency of 9 MHz) is negligible small in temperature coefficient in the vicinity of room temperature, and is thus useful as a piezoelectric mass transducer for chemical sensor. Change in resonance frequency thereof corresponds directly to mass change, and the ratio can be estimated to be 1 ng/Hz [See C. G. Guilbauit and J. M. Jordan, "Analytical Uses of Piezoelectric Crystals: A Review", CRC Critical Reviews in Analytical Chemistry, Vol. 19, No. 1, pp. 1–28 (1988)]. This quartz crystal microbalance which can be used as a mass detection type chemical probe is coated with polyethylene thin film to a thickness of about 0.5 $\mu$m on both sides of quartz plate.

Figure 12:
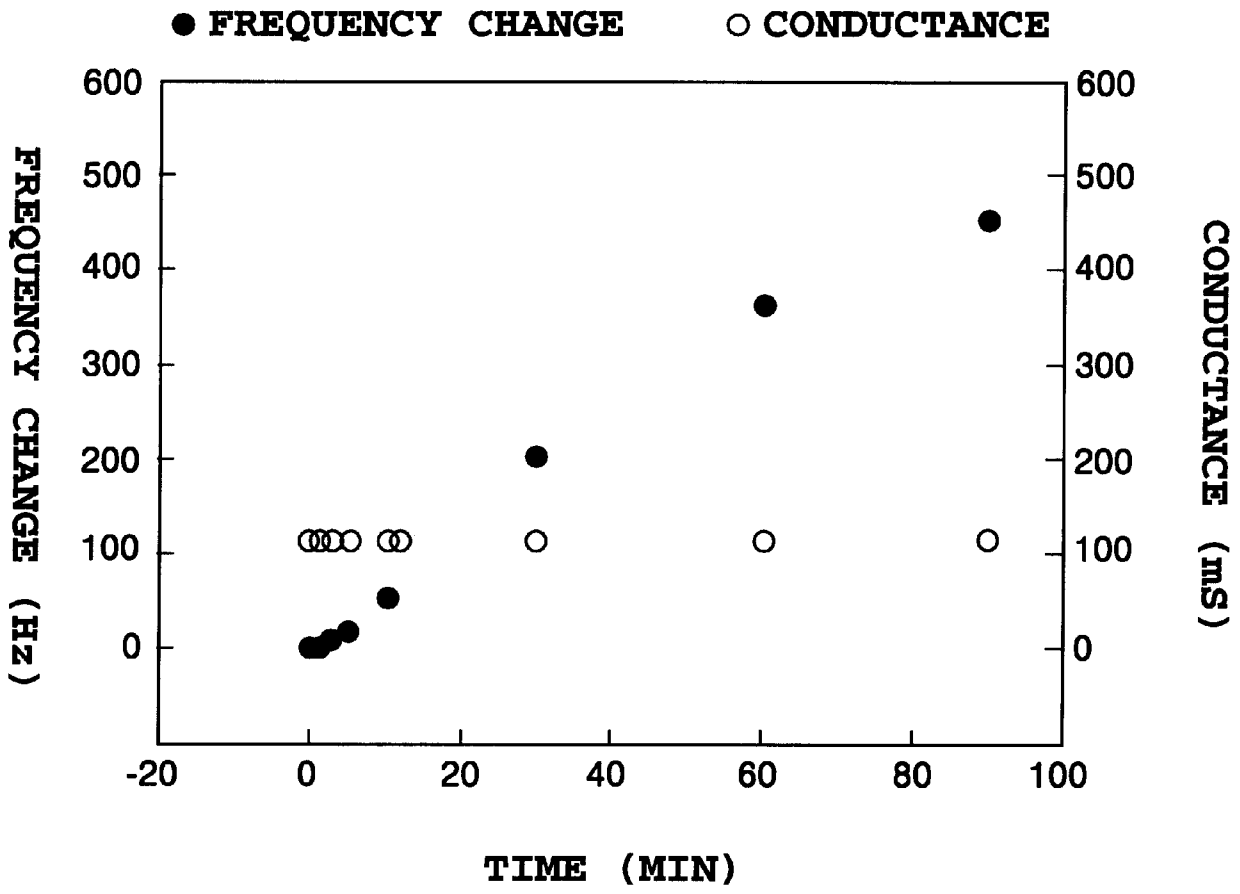
FIG. 12 is a diagram showing the time-dependent changes in resonance frequency and conductance when an AT-cut quartz crystal microbalance (resonance frequency: 9 MHz) coated with a polyethylene thin film is exposed at 28° C. to the flow of toluene gas in a concentration of 100 ppm (air-diluted) exemplified in an embodiment of the present invention.

FIG. 12 shows results of changes in frequency and conductance with time when the chemical sensor probe is exposed to a flow of 100-ppm toluene vapor at 28°0 C., using a network analyzer (Hewlett Packard 4195A). At the same time of exposure to toluene gas, the resonance frequency begins to decrease, and frequency change amount increases with the elapse of time. Because the frequency is measured with an accuracy of 0.1 Hz, gas detection with high sensitivity is possible within short time with low noise. Furthermore, since the conductance is constant at about 110 mS, it is shown that these frequency changes reflect mass changes, not by softening of the film due to gas-sorption or by phase changes of polymer film. As shown above, there is no structural change of the film itself even when it absorbs the high concentration vapor, and the probe works as a reliable chemical sensor probe. Further, when gas flow was changed from organic vapor to pure air flow of dilution gas, the frequency returned to the original value, thus indicating the reversible function between adsorption and desorption.

Moreover, results of measuring mass changes induced by gas-sorption for various types of organic vapor are shown in Table 1. The concentration of organic vapor is 20 ppm, and the mass change is calculated from frequency shift for three hours. In this table, the number of absorbed molecules normalized by the film thickness is used as an unit of absorbed gas concentration in the films. Comparing the polar and nonpolar gases, the sorption concentration is higher for the former than for the latter. Among those of organic vapors classified as the same functional group, the greater in molecular weight (the greater in carbon chain), the higher in sorption concentration. It is noteworthy to be mentioned that the organic molecules containing cyclohexane ring is not likely to be sorbed. As shown above, it can be recognized that the present chemical probe has a wide application range.

Gas-sorption characteristics of the films are closely correlated with the oxygen concentration of the polymer thin film. In the present embodiment, a hydrocarbon polymer thin film having an oxygen ratio of 10% was used, however, the oxygen ratio could be flexibly changed by changing the sputtering condition. It has been found that when the oxygen ratio in the hydrocarbon polymer thin film is in the range from 2 to 20%, the thin film exhibits superior gas-sorption characteristics similar to those shown in the embodiment.

Table 1 shows the absorption gas-concentration for 20-ppm organic vapors at 28° C. in an AT-cut quartz crystal microbalance (resonance frequency 9 MHz) coated with a polyethylene thin film as described in the present embodiments 3 and 4.

TABLE 1

| Absorbed gas-concentration of 20-ppm organic vapors | |
|---|---|
| Organic vapor | Absorbed gas-concentration (mmol/l) |
| n-Hexane | 53.4 |
| n-Heptane | 50.1 |
| n-Octane | 70.1 |
| Cyclohexane | 2.6 |
| Benzene | 47.7 |
| Toluene | 90.3 |
| o-Xylene | 34.7 |
| m-Xylene | 63.3 |
| p-Xylene | 85.3 |
| Chlorobenzene | 129.1 |
| Acetone | 42.8 |
| 2-Butanone | 90.3 |
| 2-Hexanone | 121.4 |
| Methyl acetate | 32.9 |
| Ethyl acetate | 78.4 |
| Cyclohexanol | 13.1 |
| Acetaldehyde | 38.7 |
| Methylcellosolve | 237.2 |

EMBODIMENTS 5 & 6

Fifth and sixth embodiments of the present invention relate to preparation methods of an organic thin film and a chemical sensor probe. They are especially pertaining to a preparation method of an thickness-controllable organic thin film which has the high adhesiveness to the substrate and has a strong intermolecular interaction, and to a formation method of a chemical sensor probe using the organic thin film.

The fifth embodiment of the present invention relates to a preparation method of an organic thin film having a strong intermolecular interaction, characterized in that an organic thin film is formed by a sputtering method using an organic material as a target and using an inductively coupled plasma ion source.

In addition, the sixth embodiment of the present invention relates to a preparation method of a chemical sensor probe, characterized by the fact that an organic thin film is coated on the piezoelectric mass transducer by sputtering using an organic material as a target and using an inductively coupled plasma ion source.

With the present embodiments 5 and 6, gas-sorption active points can be incorporated in a sputtered polymer thin film with high atomic density by using an inductively coupled plasma capable of generating a high density, and high energy plasma as primary sputtering beam.

In the following, the fifth and sixth embodiments of the present invention will be described in further detail with reference to the figures.

Figure 13:
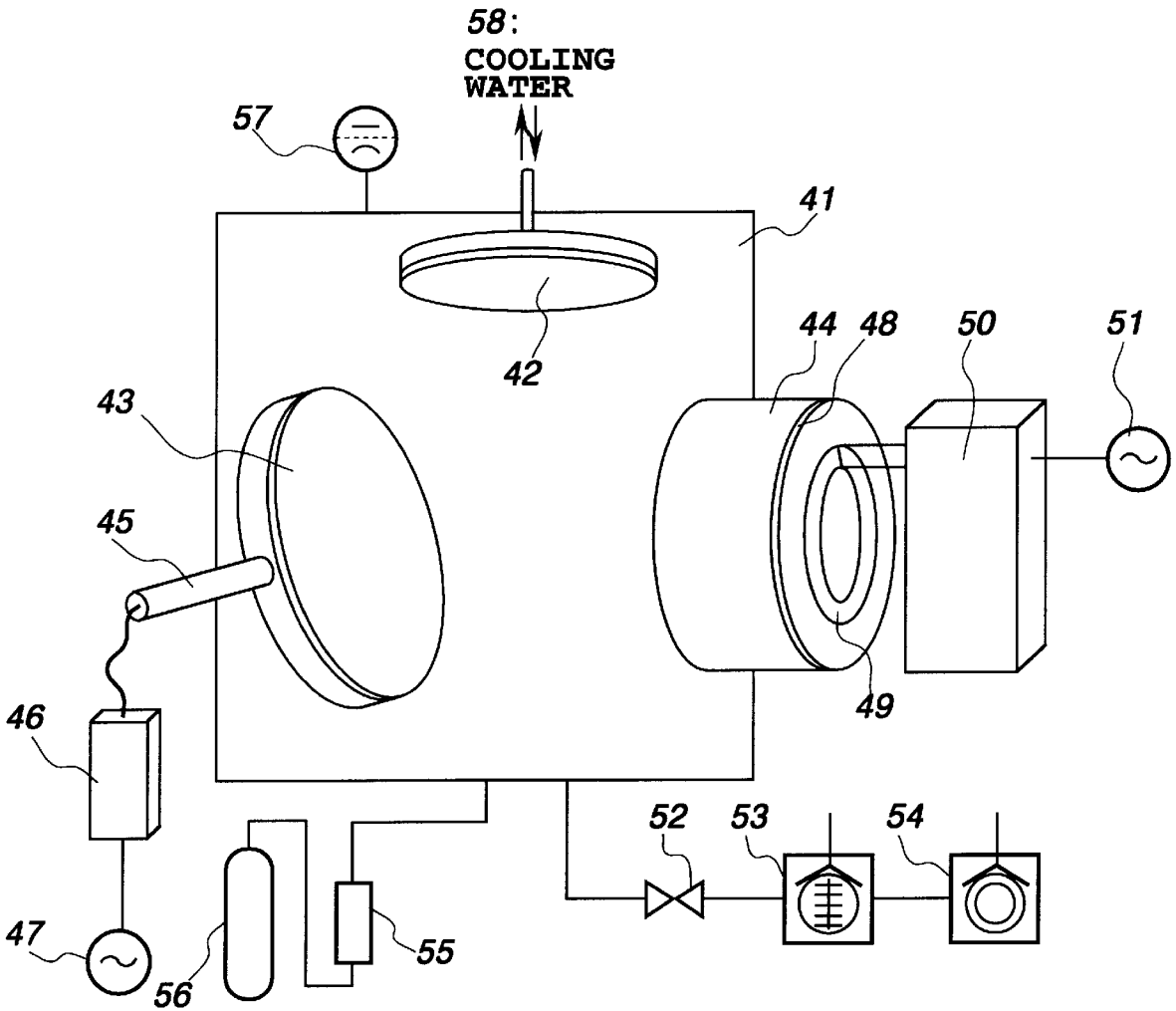
FIG. 13 is a diagram showing the structure of an inductively coupled plasma sputtering apparatus exemplified in an embodiment of the present invention.

FIG. 13 shows an example of the schematic diagram of an inductively coupled plasma sputtering apparatus according to the fifth and sixth embodiments.

As shown in the figure, the inductively coupled plasma sputtering apparatus comprises a vacuum chamber 41 which is evacuated to the high vacuum-level, a substrate holder 42 mounting a mass detection transducer for chemical sensor and the like, a sputtering target 43 to be a raw material of the film, a target holder 45 holding the sputtering target 43, a capacitively coupled impedance-matching controller 46 used for adjusting the impedance-matching for the sputtering target 43, a 200 KHz target biasing radio-frequency power generator 47 for applying the radio-frequency bias to the sputtering target 43, an inductively coupled plasma ion source 44 for generating an inductively coupled plasma, a quartz window 48 through which radio-frequency is to be biased, an inductively coupled impedance-matching box 50 for the inductively coupled plasma ion source 44, a 13.56 MHz radio-frequency power generator 51 applied to the inductively coupled plasma ion source 44, a copper loop antenna 49 attached to a quartz window 48, an oil rotary pump 54 and a turbo molecular pump 53 for evacuation of the vacuum chamber 41, a vacuum valve 52 for changing the evacuation flow and the turbo molecular pump 53, a helium cylinder 56 containing helium introduced into the vacuum chamber 41, a mass flow controller 55 for adjusting gas pressure in the vacuum chamber 41, and a vacuum gauge 57 for measuring the gas pressure in the vacuum chamber 41.

A preparation method of a polymer thin film using the above-mentioned inductively coupled plasma sputtering apparatus will be described.

A piezoelectric mass transducer for chemical sensor is mounted on the substrate holder 42. It can typically be a quartz crystal microbalance resonator(AT-cut, resonance frequency of 9 MHz). In some cases, a silicon wafer or a borosilicate glass plate may be used for film analysis. Further, as the sputtering target 43, an organic material as a raw material is set on the target holder 45. A wide-range of polymer material can be used as sputtering target 43 if it is a material having a vapor pressure of less than several Torr at room temperature and at a gas pressure of about $10^{-5}$ Torr. This time, a case where polychlorotrifluoroethylene (PCTFE) is used as the sputtering target 43 will be described. The PCTFE is a fluoropolymer having a structural formula of $(CFCl-CF_2)_n$.

The oil rotary pump 54 is operated, and the vacuum valve 52 is opened to begin evacuation for vacuum. When the gas-pressure decreases to about $10^{-1}$ Torr, the turbo molecular pump 53 is operated to make high vacuum evacuation. Evacuation is carried out until a gas pressure is reached at the level of $10^{-7}$ Torr.

After establishing the high vacuum condition, helium is introduced from the helium cylinder 56 at a flow rate of 9 cc/min through the mass flow controller 55, and gas pressure in the vacuum chamber 41 is adjusted to about $8\times10^{-1}$ Torr by the vacuum valve 52. At this moment, a radio-frequency power of about 200 W is applied by 13.56 MHz radio-frequency power generator 51 to generate a plasma in the inductively coupled plasma ion source 44. Further, a radio-frequency power of about 50 W is applied to the target holder 45 by the 200 KHz target-biasing radio-frequency power generator 47. Variable condensers installed in the matching controller (for ion source) 50 and the matching box (for target bias) 46 are adjusted so that a stable plasma condition is obtained, and film formation is carried out for a certain time. During this period, the substrate holder 42 is preferably water-cooled by circulating cooled water 58.

The resulting fluoropolymer thin film was analyzed for structure characterization by means of Fourier transform infrared (FTIR) spectrophotometer (Nippon Bunkosha FT/IR-5M) equipped with a mercury-cadmium-tellurium (MCT) detector and X-ray photoelectron spectrometer (XPS, VG Co. ESCALAB. MK-2) using Mg-Kα radiation as an excitation source.

To compare with the sputtered films produced by inductively coupled plasmas as described in the present embodiments 5 and 6, the analytical results are shown for the conventionally sputtered PCTFE film obtained by a diode-type capacitively coupled radio-frequency sputtering apparatus which has been widely used as a sputtering coater. The sputtered PCTFE films produced by the inductively coupled plasma, as described in the present embodiments 5 and 6, show the different spectra between one which is held on the substrate holder and one which is placed on the peripheral end of the inductively coupled plasma ion source. These are shown as an inductively coupled plasma film 1 and an inductively coupled plasma film 2, respectively.

Figure 14:
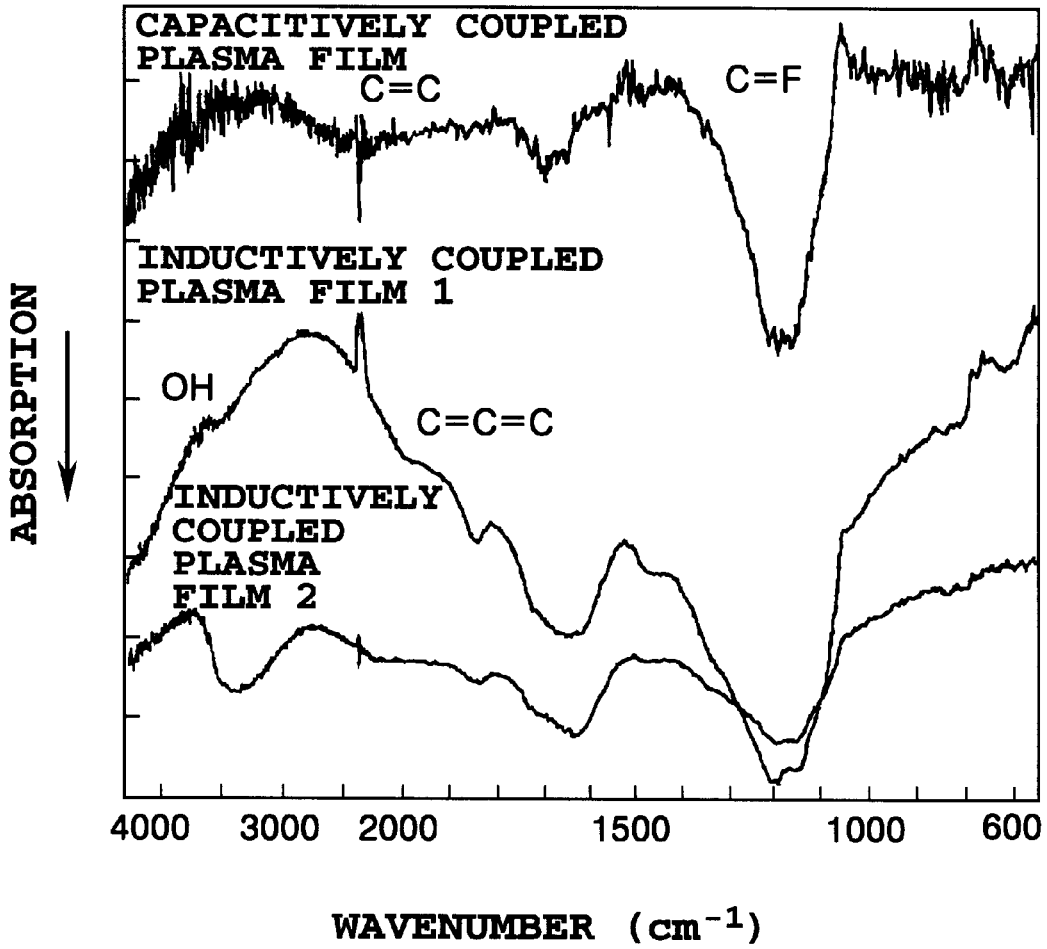
FIG. 14 is a diagram showing the Fourier transform infrared spectra of polychlorotrifluoroethylene films exemplified in an embodiment of the present invention.

FIG. 14 shows the FTIR spectra of the sputtered PCTFE film. First, the capacitively coupled plasma film exhibits the strong signal arisen from the stretching vibration of C—F bond at around 1180 $cm^{-1}$. And, the signal caused by stretching vibration of C═C bond produced by elimination reaction of halogen is weakly observed at around 1650 $cm^{-1}$, and this signal is an index of estimating the number of unsaturated bond generated by dehalogenation reactions. The inductively coupled plasma films show the weaker signals of C—F bonds and the stronger signals of the C═C bonds, comparing to the capacitively coupled plasma film. A signal of C═C═C bond produced by the subsequent dehalogenation can also be observed. Particularly in the spectra of the inductively coupled plasma film 2, the signal of C—F bonds considerably weaken and the O—H stretching bind are clearly observed. As shown above, it is found that in the inductively coupled plasma film, the bond dissociation by high-density plasma is promoted, resulting the large number of unsaturated carbons in the film-constituting carbon networks. The O—H bonds, which are not observed in the raw material, are considered to be produced by radical reactions with an oxygen source such as water or oxygen remaining in the vacuum chamber.

Figure 15:
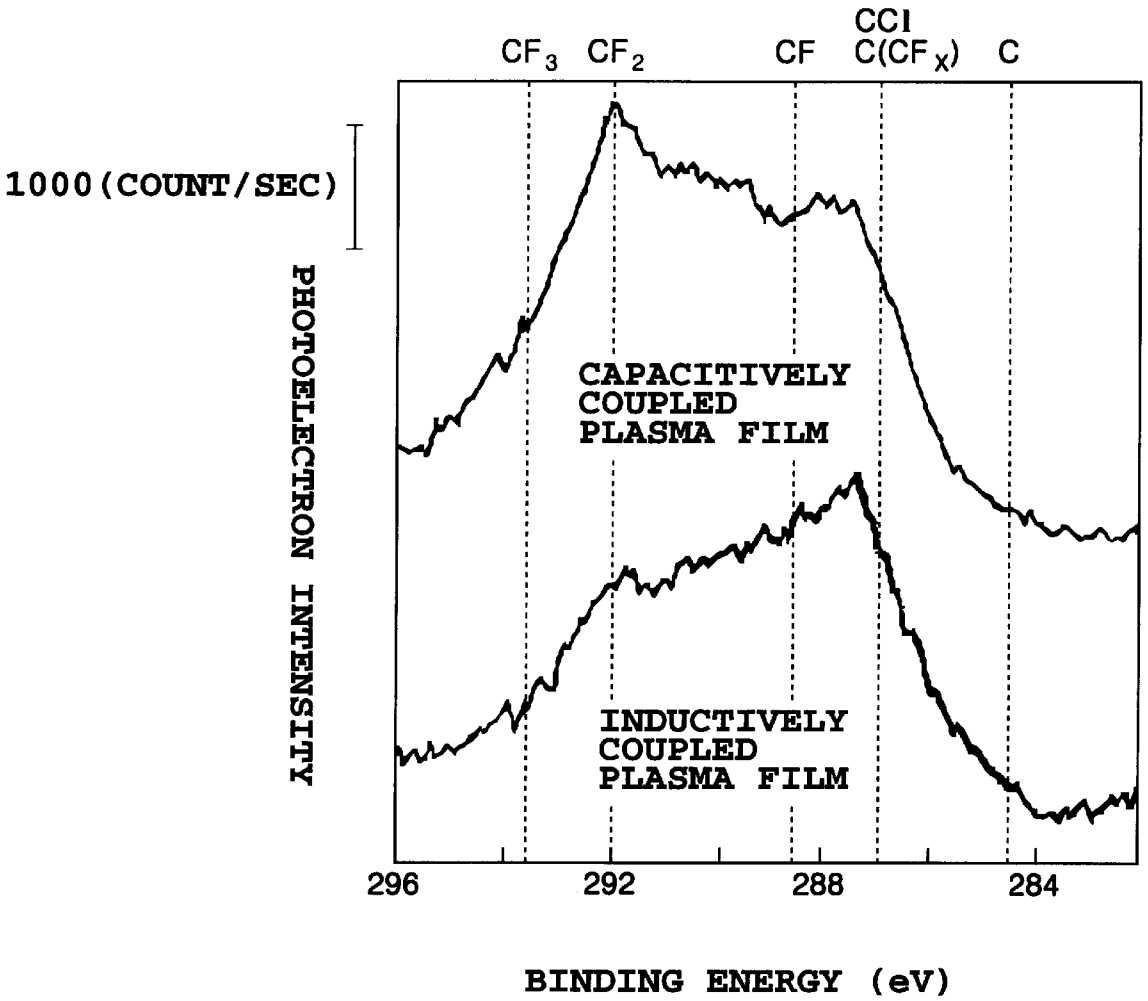
FIG. 15 is a diagram showing the $C_{1S}$ region spectra of X-ray photoelectron spectroscopy analysis for a polychlorotrifluoroethylene sputtered film exemplified in an embodiment of the present invention.

FIG. 15 shows the XPS spectra of $C_{1S}$ region. In these XPS spectra, there is no noticeable difference between the inductively coupled plasma film 1 and the inductively coupled plasma film 2. First, for the prior art capacitively coupled plasma film, there is a main peak in $CF_2$ region, which indicates that the PCTFE skeleton is not considerably destroyed. Next, in the inductively coupled plasma film according to the present embodiments 5 and 6, the signal strength of $CF_2$ region is reduced, and the signals of the defluorinated moieties, such as CF, C(CFx) or CCl, become to be main peaks. Moreover, oxygen is detected in the inductively coupled plasma film, which has not been detected in the prior art capacitively coupled plasma film, and the film constituting element ratio is: carbon: 41%, fluorine: 32%, chlorine: 19%, and oxygen: 7%.

These results are in accordance with the FTIR analytical results. That is, in the FTIR analysis, the inductively coupled plasma films shows the considerable decreases in their signal intensity of C—F bonds in comparison with the capacitively coupled plasma film. This is closely correlate with the reduction of $CF_2$ signal in the XPS analysis.

As described above, the progressing the defluorination reactions leads to increases the number of radical sites or multiple bond, and the structural changes such as strengthening the carbon networks by crosslinking bonds induced by radical-coupling reaction. In the inductively coupled plasma film, there exists the oxygen atoms, which are confirmed by the formation of O—H bond clarified by the FTIR analysis. In spite of the fact that the inductively coupled plasma film is prepared in the lower gas pressure according to the present embodiments 5 and 6 than the prior art capacitively coupled plasma film, the oxygen atoms are incorporated in the inductively coupled plasma film and are not in the film. This finding suggests that the bond dissociation is promoted by high-density plasma resulting the large number of the reactive radical sites, which react with an oxygen source remaining in the vacuum chamber.

Based on the findings revealed by structural analysis, we can show the sputtering effect induced by high-density plasma. By using this technique, it has become possible to introduce multiple bonds or oxygen atoms with high density into carbon networks of the plasma polymer films. These films are expected to interact strongly with other molecules and to function as a useful chemical-sensing probe.

Then, gas-sorption characteristics as a chemical-sensing probe will be described. The thickness-shear mode of a quartz crystal microbalance (AT-cut, resonance frequency: 9 MHz) has a negligible temperature coefficient near room temperature. This property is useful as a piezoelectric mass transducer for chemical sensor. The changes in resonance frequency corresponds directly to mass change, and its ratio can be converted by 1 ng/Hz [See G. G. Guilbauit and J. M. Jordan, "Analytical Uses of Piezoelectric Crystals: A Review", CRC Critical Reviews in Analytical Chemistry, Vol. 19, No. 1, pp. 1–28 (1988)]. This quartz crystal microbalance coated with the induction coupled plasma film according to the present embodiments 5 and 6 can be used as a mass-detection-type chemical sensor probe.

Figure 16:
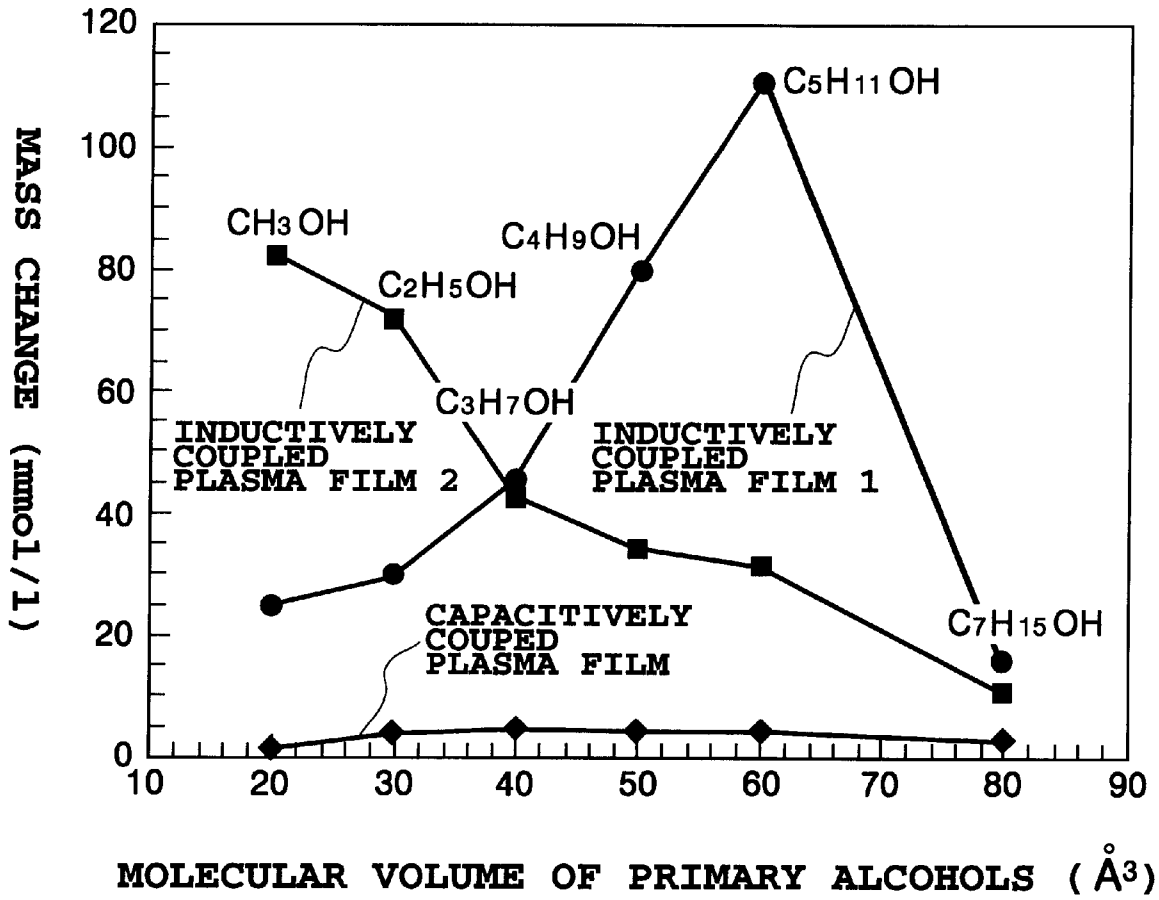
FIG. 16 is a diagram showing the gas-sorption concentration of the polychlorotrifluoroethylene films for various primary alcohol gases in a concentration of 20 ppm (air-diluted) exemplified in an embodiment of the present invention.

FIG. 16 shows the gas concentrations absorbed in the films for three hours in the gas-flow of 20 ppm (air-diluted) primary alcohols. The chemical sensor probe of quartz crystal microbalance coated on both surfaces with sputtered PCTFE films with film thicknesses of about 0.51 $\mu$m is exposed to the gas flow of 20 ppm primary alcohols at 28° C. Here, the molar number of absorbed molecules normalized by the film thickness is represented as an unit of gas concentration in the film, so that the affinities for any types of vapors can be numerically evaluated.

In comparison with the prior art capacitively coupled plasma film (Japanese Patent Application Laid-open No. 4-103636), the inductively coupled plasma film according to the present embodiments 5 and 6 has large sorption concentrations for ranging the increased in mass changes, primary alcohols, showing that sensitivity as a chemical sensor is markedly improved. The sorption concentration of the largest carbon chain, heptyl alcohol ($C_7H_5OH$), is small in all cases, however, the dependence of molecular volume with sorption concentration exhibits the reverse tendency between the inductively coupled plasma film 1 and the inductively coupled plasma film 2. This is understandable that since in the latter film the incorporation of O—H bonds is clearly confirmed by the FTIR analysis, the smaller the carbon chain in an alcohol, the stronger the nature of OH group is. These small alcohols strongly interacts with O—H bond of the film by means of interactions by polar character, such as dipole moment or hydrogen bond, thereby increasing the sorption concentration. For the case of the inductively coupled plasma film 1, O—H signal is very weak, however, compared to the capacitively coupled plasma film, the signal of double bond is increased and the signal of C—F bonds is decreased. These spectral changes indicate the increases in concentration of components responsible for polarization such as double bonds or crosslinking bonds. Increasing the polarizability in carbon chain can enhance the sorption capacity and the affinity tendency can be altered by introduction of polar moieties in the film networks.

When gas flow was changed from alcohol vapor to the pure air, the frequency of the film-coated quartz crystal microbalance returned to the original value, suggesting the reversible behavior between absorption and desorption of the film.

The sorption concentration for any types of 20-ppm organic vapors are shown in Table 2. Table 2 shows that as compared with the prior art capacitively coupled plasma film, the inductively coupled plasma film according to the present embodiments 5 and 6 can absorb various kinds of gases at high concentrations. In particular, the sorption concentrations are quite large for polar gases, indicating that this chemical sensor probe is useful for highly sensitive sensing device.

Plasma densities applied when the films are formed are responsible for differences in gassorption characteristics between the inductively coupled plasma film 1 and the inductively coupled plasma film 2. In the configuration of the sputtering apparatus used in the present embodiments, the central position of the substrate holder (for inductively coupled plasma film 1) is higher in plasma density than the peripheral end of he inductively coupled plasma ion source (for inductively coupled plasma film 2). Thus, the films with different gas-sorption characteristics are obtained depending on their location in the vacuum chamber. In general, the higher the plasma densities, the higher the density of interactive point is to be produced, as shown in FIG. 16. That is, the respective films with different structures, which can be controlled, may have superior gas-sorption characteristics depending on the solute gas species. Plasma density can be varied or equalized in the vacuum chamber by controlling the configuration in the chamber and plasma parameters, such as applied voltage and pressure. Therefore, it is possible to satisfactorily obtain an uniform film having gas-sorption characteristics either one of the resulting two extreme types or one medium characteristics between them. In either of the cases, as shown in the present embodiments, the inductively coupled plasma films having superior absorption characteristics can be obtained compared to the prior art capacitively coupled plasma film. Similarly, we can realize a chemical sensor probe which is a adaptable for the practical purpose, by appropriate controlling the preparation conditions.

Table 2 shows the absorbed gas-concentration of the sputtered polychlorotrifluoroethylene films exemplified in the present embodiments 5 and 6 for several 20-ppm (air diluted) organic vapors.

TABLE 2

| | Absorbed gas-concentration of 20-ppm organic vapors | |
|---|---|---|
| Organic vapor | Absorbed gas-concentration of a prior art capacitively coupled plasma film (mmol/l) | Absorbed gas-concentration of inductively coupled plasma film (mmol/l) |
| n-Hexane | 0.68 | 1.43 |
| n-Heptane | 0.92 | 1.58 |
| n-Octane | 1.25 | 1.05 |
| Cyclohexane | 0 | 0.50 |
| Benzene | 1.65 | 4.20 |
| Toluene | 4.68 | 6.13 |
| o-Xylene | 2.87 | 2.32 |
| m-Xylene | 7.03 | 4.26 |
| p-Xylene | 9.53 | 7.00 |
| Chlorobenzene | 10.91 | 15.99 |
| Acetone | 5.85 | 23.49 |
| 2-Butanone | 11.62 | 28.41 |
| 2-Hexanone | 18.81 | 10.69 |

TABLE 2-continued

| Organic vapor | Absorbed gas-concentration of 20-ppm organic vapors: Absorbed gas-concentration of a prior art capacitively coupled plasma film (mmol/l) | Absorbed gas-concentration of inductively coupled plasma film (mmol/l) |
|---|---|---|
| Methyl acetate | 5.06 | 20.23 |
| Ethyl acetate | 10.57 | 22.90 |
| Cyclohexanol | 0.24 | 0.90 |

The present invention has been described centering preferred embodiments. However, as understood by those skilled in the art, these embodiments are given by way of illustration only, and various changes and modifications are possible within the spirit and scope of the invention.

What is claimed:

1. A fire detection method comprising:

detecting humidity increases in a plurality of places by a plurality of sensor apparatuses respectively disposed at said plurality of places to be detected for a fire; and recognizing a fire when humidity increases detected in one or more of the plurality of places are greater than humidity increases detected in other of the places.

2. The fire detection method as claimed in claim 1, wherein the detecting humidity increases in a plurality of places comprises:

detecting resonance frequency changes according to mass changes of detected gases on films from outputs of said sensor apparatuses provided with a plurality of quartz crystal microbalances respectively having different said films formed on the surfaces;

processing said resonance frequency changes;

recognizing a gas type of detected gas by matching data of processing result obtained in said processing step with a previously prepared database; and repeating from said detecting step to said recognizing step successively for each of said plurality of sensor apparatuses.

3. The fire detection method as claimed in claim 2, further comprising detecting generation of burning gas due to a fire by matching data of processing result obtained in said processing step with said database continuously, when the detected gas is recognized as a water vapor by said recognizing step.

4. The fire detection method as claimed in claim 2, wherein recognizing a gas type makes recognition of said gas type using a pattern recognition method of principal component analysis.

5. The fire detection method as claimed in claim 3, further comprising a step which when a humidity increase is detected by said recognizing step and it is highly possible to be a fire, in a classification map of principal component analysis as said database, a distance $D_t$ between a response Y of said sensor apparatus and the center of cluster of burning gas is calculated, said distance $D_t$ and an immediately previous distance $D_{t-1}$ are compared, if $D_t<D_{t-1}$, a flag S is incremented by 1, if $D_t>D_{t-1}$, the flag S is reset to 0, this procedure is repeated several times, and when S exceeds a reference number of times M, response Y of said sensor apparatus is recognized to approach the cluster of burning gas to recognize a fire.

6. A fire detection apparatus comprising:

detection apparatus for detecting humidity increases in a plurality of places by a plurality of sensor apparatuses respectively disposed at said plurality of places to be detected for a fire; and recognizing apparatus for recognizing a fire when humidity increases detected at one or more places are greater than humidity increases detected in other places.

7. The fire detection apparatus, as claimed in claim 6, wherein said detection apparatus comprises:

first processing apparatus for detecting frequency changes according to mass changes of detected gases on films from outputs of said sensor apparatuses provided with a plurality of quartz crystal microbalances respectively having different said films formed on the surfaces;

second processing apparatus for processing said resonance frequency changes;

third processing apparatus for recognizing a gas type of detected gas by matching data of processing result obtained by said second processing apparatus with a previously prepared database; and processing apparatus for repeating from said first processing apparatus to third processing apparatus successively for each of said plurality of sensor apparatuses.

8. The fire detection apparatus as claimed in claim 7, wherein said recognizing apparatus detects generation of burning gas due to a fire by matching data of processing result obtained by said second processing apparatus with said database continuously, when the detected gas is recognized as a water vapor by said third processing apparatus.

9. The fire detection apparatus as claimed in claim 7, wherein said third processing apparatus makes recognition of said gas type using a pattern recognition method of principal component analysis.

10. The fire detection apparatus as claimed in claim 7, wherein said recognizing apparatus which when a humidity increase is detected by said third processing apparatus and it is recognized as highly possible to be a fire, in a classification map of principal component analysis as said database, a distance D between a response Y of said sensor apparatus and the center of cluster of burning gas is calculated, said distance $D_t$ and an immediately previous distance $D_{t-1}$ are compared, if $D_t<D_{t-1}$, a flag S is incremented by 1, if $D_t>D_{t-1}$, the flag S is reset to 0, this procedure is repeated several times, and when S exceeds a reference number of times M, response Y of said sensor apparatus is recognized to approach the cluster of burning gas to recognize a fire.

11. The fire detection apparatus as claimed in claim 6, wherein said detection apparatus comprises, by sputtering a sintered polymer formed by hot-pressing granules of hydrocarbon polymers with particle diameters ranging from 50 to 200 micrometers, a chemical sensor probe having a hydrocarbon-based polymer thin film on a piezoelectric mass transducer, said hydrocarbon-based polymer thin film containing carbon, hydrogen, and oxygen, and content of said oxygen is within a range from 2 to 20%.

12. The fire detection apparatus as claimed in claim 11, wherein said polymer thin film is formed by, when sputtering a sputtering target in a radio-frequency discharge, using a sintered polymer formed by hot-pressing granules of hydrocarbon polymers having particle diameters ranging from 50 to 200 micrometers as the sputtering target.

13. The fire detection apparatus as claimed in claim 6, wherein said detection apparatus comprises, on the surface of a piezoelectric mass transducer, a chemical sensor probe having an organic thin film by spattering with an organic material as a target and with an induction coupled plasma ion source.

14. The fire detection apparatus as claimed in claim 13, wherein said organic thin film is formed by a sputtering with an organic material as a target and with an induction coupled plasma ion source.

15. A recording medium storing a fire detection program for making fire detection by a computer, said fire detection program causes said computer:

to detect humidity increases in a plurality of places by a plurality of sensor apparatuses respectively disposed at said plurality of places to be detected for a fire; and to recognize a fire when detected humidity increase in one or more places are greater than detected humidity increases in other places.

16. The recording medium as claimed in claim 15, wherein said fire detection program causes said computer, when detecting humidity changes in said plurality of places:

to detect resonance frequency changes according to mass changes of detected gases on films from outputs of said sensor apparatuses provided with a plurality of quartz crystal microbalances respectively having different said films formed on the surfaces;

to process said resonance frequency changes;

to recognize a gas type of detected gas by matching data of said processing result with a previously prepared database; and to repeat said respective operations successively for each of said plurality of sensor apparatuses.

17. The recording medium as claimed in claim 15, wherein said fire detection program causes said computer to detect generation of burning gas due to a fire by matching data of processing result with said database continuously, when said computer is caused to recognize a gas type the detected gas as water vapor.

18. The recording medium as claimed in claim 15, wherein said fire detection program causes said computer to make recognition of said gas type using a pattern recognition method of principal component analysis.

19. The recording medium as claimed in claim 15, wherein said fire detection program causes said computer, in a classification map of principal component analysis as said database, to calculate a distance $D_t$ between a response Y of said sensor apparatus and the center of cluster of burning gas, compare said distance $D_t$ with an immediately previous distance $D_{t-1}$, if $D_t<D_{t-1}$, increment a flag S by 1, if $D_t>D_{t-1}$, reset the flag S to 0, repeat this procedure several times, and when S exceeds a reference number of times M, and recognize response Y of said sensor apparatus approaching the cluster of burning gas to recognize a fire.

* * * * *

UNITED STATES PATENT AND TRADEMARK OFFICE

CERTIFICATE OF CORRECTION

PATENT NO. : 6,111,512
DATED : August 29, 2000
INVENTOR(S) : Iwao Sugimoto et al.

It is certified that error appears in the above-identified patent and that said Letters Patent is hereby corrected as shown below:

Title page,
"References Cited" Item [56], add the following references:

FOREIGN PATENT DOCUMENTS

| | |
|---|---|
| JP 4-103636 | Published April 6, 1992 |
| JP 3-24262 | Published February 1, 1991 |

OTHER REFERENCES

Sugimoto et al., "Plasma-Organic-Film-Coated QCM Device for VOC-Sensing," in Proceedings of the Symposium on Chemical and Biological Sensors and Analytical Electrochemical Methods, Proceedings Volume 97-19, pp. 848-861 (Sept. 1997).

Sugimoto et al., "Plasma-Organic-Film-Coated QCM Device for VOC-Sensing," Meeting Abstracts, The 1997 Joint International Meeting of the Electrochemical Society and the International Society of Electrochemistry, Volume 97-2, Abstract No. 742 (Sept. 1997).

Sugimoto et al., "Chemical-Sensing Structure, Direction, and Qualification of Plasma-Organic Films with X-Amino Acids," Sensors and Actuators B 35-36 (1996) 342-347.

Guilbault et al., "Analytical Uses of Piezoelectric Crystals: A Review," CRC Critical Reviews in Analytical Chemistry, Vol. 19, Issue 1 (1998).

Kasai et al., "Aging Effect on RF-Sputtered Polyethylene Film, "Polymer Reprints, Japan, Volume 46, No. 14 (1997).

Nakamura et al., "Chemical Sensing System Using Plasma-Synthesized Fluoropolymer films," NTT R & D, Vol. 42, No. 7, (1993).

UNITED STATES PATENT AND TRADEMARK OFFICE

CERTIFICATE OF CORRECTION

PATENT NO. : 6,111,512
DATED : August 29, 2000
INVENTOR(S) : Iwao Sugimoto et al.

It is certified that error appears in the above-identified patent and that said Letters Patent is hereby corrected as shown below:

Nakamura et al., "Chemical System Using Plasma-Synthesized Organic Films," NTT R & D, Vol. 45, No. 9, (1996).

Nakamura et al., "Fire Detection by Quartz Crystal Microbalance Chemical Sensors," NTT Integrated Information & Energy Systems Laboratories, Exhibit at Sensor 97, Germany, May 13-15, (1997).

Signed and Sealed this

Twentieth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,111,512
DATED : August 29, 2000
INVENTOR(S) : Iwao Sugimoto et al.

It is certified that error appears in the above-identified patent and that said Letters Patent is hereby corrected as shown below:

Title page,
"References Cited" Item [56], add the following references:

FOREIGN PATENT DOCUMENTS

| | |
|---|---|
| JP 4-103636 | Published April 6, 1992 |
| JP 3-24262 | Published February 1, 1991 |

OTHER REFERENCES

Sugimoto et al., "Plasma-Organic-Film-Coated QCM Device for VOC-Sensing," in Proceedings of the Symposium on Chemical and Biological Sensors and Analytical Electrochemical Methods, Proceedings Volume 97-19, pp. 848-861 (Sept. 1997).

Sugimoto et al., "Plasma-Organic-Film-Coated QCM Device for VOC-Sensing," Meeting Abstracts, The 1997 Joint International Meeting of the Electrochemical Society and the International Society of Electrochemistry, Volume 97-2, Abstract No. 742 (Sept. 1997).

Sugimoto et al., "Chemical-Sensing Structure, Direction, and Qualification of Plasma-Organic Films with X-Amino Acids," Sensors and Actuators B 35-36 (1996) 342-347.

Guilbault et al., "Analytical Uses of Piezoelectric Crystals: A Review," CRC Critical Reviews in Analytical Chemistry, Vol. 19, Issue 1 (1998).

Kasai et al., "Aging Effect on RF-Sputtered Polyethylene Film, "Polymer Reprints, Japan, Volume 46, No. 14 (1997).

Nakamura et al., "Chemical Sensing System Using Plasma-Synthesized Fluoropolymer films," NTT R & D, Vol. 42, No. 7, (1993).

UNITED STATES PATENT AND TRADEMARK OFFICE

CERTIFICATE OF CORRECTION

PATENT NO. : 6,111,512
DATED : August 29, 2000
INVENTOR(S) : Iwao Sugimoto et al.

It is certified that error appears in the above-identified patent and that said Letters Patent is hereby corrected as shown below:

Nakamura et al., "Chemical System Using Plasma-Synthesized Organic Films," NTT R & D, Vol. 45, No. 9, (1996).

Nakamura et al., "Fire Detection by Quartz Crystal Microbalance Chemical Sensors," NTT Integrated Information & Energy Systems Laboratories, Exhibit at Sensor 97, Germany, May 13-15, (1997).

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*